United States Patent [19]

Bochan

[11] 4,328,600

[45] May 11, 1982

[54] WASHING MACHINE

[75] Inventor: John Bochan, Louisville, Ky.

[73] Assignee: General Electric Company, Louisville, Ky.

[21] Appl. No.: 142,949

[22] Filed: Apr. 23, 1980

Related U.S. Application Data

[63] Continuation-in-part of Ser. No. 39,406, May 15, 1979, abandoned.

[51] Int. Cl.[3] ..... D06F 23/00; D06F 37/30

[52] U.S. Cl. ..... 8/159; 68/17 A; 68/18 D; 68/23 R; 68/171; 68/207; 68/208

[58] Field of Search ..... 8/158, 159; 68/17 R, 68/17 A, 18 D, 23 R, 23.1, 23.2, 23.3, 23.4, 23.5, 23.6, 23.7, 53, 134, 148, 152, 154, 171, 172, 173, 174, 181 R, 184, 207, 208

[56] References Cited

U.S. PATENT DOCUMENTS

| | | | |
|---|---|---|---|
| 1,688,555 | 10/1928 | Rankin . | |
| 2,278,911 | 4/1942 | Breckinridge | 68/23.5 |
| 2,331,699 | 10/1943 | Kirby | 68/18 D X |
| 2,344,253 | 3/1944 | Kirby | 68/12 R |
| 2,372,769 | 4/1945 | De Remer . | |
| 2,416,611 | 2/1947 | Castricone | 68/53 |
| 2,432,272 | 12/1947 | Bariffi . | |
| 2,432,766 | 12/1947 | Kirby | 68/19 X |
| 2,520,366 | 8/1950 | Kirby | 68/148 |
| 2,535,390 | 12/1950 | Castricone | 68/131 |
| 2,549,824 | 4/1951 | Kost | 68/172 |
| 2,555,400 | 6/1951 | De Remer | 68/172 X |
| 2,574,617 | 11/1951 | Bryant . | |
| 2,580,435 | 1/1952 | Kirby . | |
| 2,604,771 | 7/1952 | De Remer . | |
| 2,636,374 | 4/1953 | Castricone | 68/134 |
| 2,658,372 | 11/1953 | Kirby . | |
| 2,672,744 | 3/1954 | Kirby | 68/152 |
| 2,681,557 | 6/1954 | Conord . | |
| 2,695,510 | 11/1954 | Clark . | |
| 2,755,651 | 7/1956 | Castricone | 68/131 |
| 2,797,569 | 7/1957 | Kirby . | |
| 2,854,297 | 9/1958 | Scott et al. . | |
| 2,863,311 | 12/1958 | Brucken | 68/12 R |
| 2,897,665 | 8/1959 | Miller . | |
| 2,921,459 | 1/1960 | Long . | |
| 2,930,215 | 3/1960 | Smith . | |
| 2,973,637 | 3/1961 | Sisson | 68/18 D X |
| 3,021,956 | 2/1962 | Bochan . | |
| 3,068,975 | 12/1962 | Theuer . | |
| 3,086,380 | 4/1963 | Gerhardt et al. | 68/17 A |
| 3,247,689 | 4/1966 | Wasemann . | |
| 3,263,459 | 8/1966 | Bochan et al. . | |
| 3,277,742 | 10/1966 | Jacobsen . | |
| 3,603,118 | 9/1971 | Brucken et al. | 68/23 R |
| 3,648,486 | 3/1972 | Rosinski, Jr. et al. | 68/154 X |
| 3,738,130 | 6/1973 | Smith | 68/154 |
| 3,744,746 | 7/1973 | Weir et al. | 68/23.3 X |
| 3,952,557 | 4/1976 | Bochan | 68/23.3 |

FOREIGN PATENT DOCUMENTS

| | | | |
|---|---|---|---|
| 151477 | 5/1953 | Australia | 68/23 R |
| 222610 | 8/1962 | Austria . | |
| 600497 | 4/1948 | United Kingdom . | |
| 636528 | 5/1950 | United Kingdom . | |
| 653863 | 5/1951 | United Kingdom . | |
| 656615 | 8/1951 | United Kingdom . | |
| 745141 | 2/1956 | United Kingdom . | |
| 888204 | 1/1962 | United Kingdom . | |

*Primary Examiner*—Philip R. Coe

*Attorney, Agent, or Firm*—Radford M. Reams

[57] ABSTRACT

An automatic washing machine of the fresh-water, vertical-axis type has a dynamic system which includes a single perforate wash basket arranged to be driven continuously such that its central axis moves in an orbital path about another axis. The basket is restrained from rotating about its central axis when it is moving about the other axis and each point of the basket moves in a circulate path having an effective diameter which is small in relation to the diameter of the basket and having substantially the same excursion as the orbital path of the central axis of the basket. Water and soil removing agent are introduced into the basket during orbital motion and that motion is effective to induce a continuous motion of the fabric article load for washing the load. The machine tub and other working components are placed in the moving system and provide a stable base for the basket. Following washing, preferably the basket's central axis is positioned in substantial alignment with the axis about which it was orbiting and is rotated about this axis to centrifugally remove water from the fabric load. The basket is contoured to enhance toroidal and annular movement of the fabric load. The machine transmission has an input shaft driven by a reversible electric motor, and an output shaft connected to the basket, the transmission having drive elements for interconnecting the output shaft and the input shaft. The drive elements include eccentric drive members operative to shift the axis of the output shaft laterally from the axis of the input shaft when the input shaft is rotated in one direction, thereby driving the output shaft in an orbital path about the axis of the input shaft, and operative to return the axis of the output shaft from its laterally offset relationship when the input shaft is rotated in the other direction, thereby causing the output shaft to rotate about the axis of the input shaft. A one-way clutch and a disc brake assembly, including an off-center coupling, cooperate with the drive elements to restrain the basket from rotating about its own axis when in the orbit mode and to rotationally drive the basket when in the water extraction mode.

72 Claims, 14 Drawing Figures

538
534
536
508
509
540
507
506
544
500
92
532
505
504
502
503
A
B
A
B
510
511
511
20
556
550
552
546
512
524
548
554
A
513
B
526
520
521
518
528
519
542
118b
516
514
530
517
515
118a
522
523
128
128
126
130

WASHING MACHINE

CROSS REFERENCE TO RELATED APPLICATION

This is a continuation-in-part of copending application Ser. No. 39,406, filed May 15, 1979, and now abandoned.

BACKGROUND OF THE INVENTION

The present invention relates to a washing machine for the washing of fabrics such as clothes and, more particularly, to a washing machine of the vertical-axis type wherein a single basket receives both the items being washed and the washing liquid.

Conventional clothes washing machines of the vertical-axis agitator type are traditionally rather large and complex. In such machines, generally there is provided a cabinet enclosing an outer water-retaining tub in which is situated an inner, clothes-receiving basket. An agitator is mounted within the inner basket. The agitator and the basket are coupled to a suitable power transmission driven by an electric motor. The transmission converts the high speed revolutions of the motor to the speed appropriate for centrifugal extraction of water and to the oscillatory motion appropriate for agitator movement during the wash cycle. Such machines generally include a water pump for recirculating water within the machine and a filter for separating out lint and other particles from the recirculated water. Included with the pump and filter mechanism is a plethora of plumbing and hoses. Inherently, such machines use large amounts of water. Also, there is a high energy interface between the clothes being washed and the oscillating agitator, causing high wear of fabrics being washed. Many machines also suffer from vibration and travelling problems resulting from unbalances in the machines during the centrifugal water extraction or spinning operation. Other machines use complex suspension systems including counterweights, and many times the clothes basket is also provided with an annular balance ring disposed somewhere around the circumference thereof to alleviate this problem.

Attempts have been made to simplify these washing machines, and especially the drive mechanisms thereof, and the "wobble" type of machine is one such effort. U.S. Pat. No. 2,555,400 to De Remer discloses a wobble type of washing machine including a non-rotating tilted spin shaft which rests against inverted conical walls of a gyrator and is moved in a conical path so that the axis of the basket describes a cone having an apex below the basket. Helical blades on the basket wall provide a vortex motion to the clothes and motion about the rotor axis in a direction opposite to movement of water and direction of gyration. A spring centering force and gyroscopic forces cause the spin shaft axis to move to a vertical position for the spin mode of operation. Many other wobble-type machines are known such as the machine shown in U.S. Pat. No. 2,549,824 to Kost, where the tub axis is made to wobble in a conical path while the tub is oscillated about its own axis. The washing motion is accomplished by an inclined post and a ball pivot, extended into a cocked off-center bearing in a worm wheel. An attached slide link provides angular placement of the post about its axis. Most of the wobble-type of washing machines share the problem of expensive complex suspension systems and such designs place very large stresses on the systems.

U.S. Pat. No. 2,432,766 to Kirby describes a washing machine wherein the clothes-receiving receptacle is caused to execute an orbital movement while at the same time being rotated about its own axis. The motion is achieved by the provision of a nested assembly of interfitting sleeves within which a drive shaft is eccentrically mounted. Rotation of the shaft causes rotation of the basket about its own axis. Although the degree of gyration appears to be much less than in a true wobble-type washer, the motion is still of the nutating or wobble type.

Other washing machines are also known in which the wash basket is oscillated, such as U.S. Pat. No. 3,738,130 in which an oscillatable basket is provided within a washing machine tub. A pair of blades are attached eccentrically to the basket for affecting a washing action. A more dated means of obtaining washing action in a vertical-axis type of machine wherein basket motion rather than agitator motion provides the washing forces is shown, for example, in U.S. Pat. No. 1,688,555 to Rankin wherein two or more clothes chambers revolve around the center of an outer water chamber, at the same time revolving on their own axis.

It is desirable then to provide a washing machine of the vertical-axis type having a relatively simple and uncomplicated drive mechanism and effective to move the wash basket so that the predominant energy transfer to the load being washed is through the basket sidewall, and without requiring expensive and complex vibration dampening and counterbalancing structure. It is also desirable to provide a washing machine wherein the mass of the suspended tub and drive components are used to advantage in both the wash and spin modes of operation. It is also desirable to provide a relatively simple and low-cost drive train or transmission; to provide a washing machine basket which may use common wash and spin speeds and which has the ability to handle large or small loads gently with minimum wear to the fabrics; and to provide a machine which has low water usage. It is also desirable to provide a washing machine in which the energy input to the fabric articles being washed is an approximate function of the load size. It is further desirable to provide a washing machine which has an effective detergent concentration level with minimum total detergent use, which has few parts and low component stress levels, which is reliable, which uses a symmetrical rotating mechanism and which has a wash basket which provides excellent clothes turnover and washability. It also is desirable to provide a flow-through wash system which continuously washes with fresh water and continuously flushes water, with its entrained lint, scum and soil, down the drain.

The present invention provides a washing machine of the vertical axis type which is rather simple of construction, highly reliable, and of economic construction and which meets one or more of the requirements above described and other objectives.

SUMMARY OF THE INVENTION

In accordance with a preferred embodiment of the present invention, there is provided a washing machine of the fresh-water, vertical-axis type having a dynamic system including a single perforate wash basket. The basket is positioned such that the central axis of the basket is offset laterally with respect to another axis and it is driven so that its central axis moves in a predetermined path about the other axis while at the same time the basket is restrained from rotating about its central axis. Each point of the basket moves in a circulate path whose radius is small in relation to the radius of the basket and is substantially equal to the radius of the orbital path of the central axis of the basket. Water and soil removing agent are introduced onto the basket during the orbital motion and that motion is effective to induce a continuous motion of the fabric article load for washing the load. The tub and other working components of the suspended system provide a substantially stable base for the basket. Following washing, the basket is positioned so that its central axis is substantially aligned with the axis about which it was orbiting and the basket is rotated about this axis to centrifugally extract water from the fabric load. The wash basket is provided with a plurality of ribs and vanes to enhance a toroidal and annular movement of the fabric load during washing.

The transmission for driving the wash basket includes a first rotary drive element driven by a reversible electric motor, a second rotary drive element mounted eccentric to the axis of and driven by the first rotary drive element for movement about the axis of rotation of the first rotary drive element, and a third rotary drive or output element mounted eccentric to the axis of and driven by the second rotary drive element for movement about the axis of rotation of the first rotary drive element. The wash basket is mounted to the third rotary drive element for movement therewith. A lost motion driving connection is provided between the first and second rotary drive elements to limit relative rotation of the first and second rotary drive elements between first and second relative angular positions. The axis of rotation of the third rotary drive element is eccentrically located with respect to the axis of rotation of the first rotary drive element when the first and second rotary drive elements are in their respective first relative angular positions for orbital washing motion of the basket. The axis of rotation of the third rotary drive element is substantially concentrically located with respect to the axis of rotation of the first rotary drive element when the first and second rotary drive elements are in their respective second relative angular positions for spinning the basket to centrifugally extract water from the fabrics. Rotation of the first rotary drive element in a first direction is effective, through the lost motion driving connection, to cause the first and second rotary drive elements to assume their first relative angular positions for orbiting, and rotation of the first rotary drive element in a second direction is effective, through the lost motion driving connection, to cause the first and second rotary drive elements to assume their second relative angular positions for spinning.

The transmission causes the central axis of the basket to orbit about the axis of the first rotary or input drive element at a predetermined distance therefrom during wash such that the central axis describes a cylinder having a radius equal to said predetermined distance. Each point on the basket describes a circulate path of diameter substantially equal to the diameter of the cylinder. During wash, the predominant energy transfer to the fabric load is through the engagement between the basket sidewall and the load. The post and bottom of the basket provide the remaining energy, usually in the listed order of contribution. Thus reference to the wall of the receptacle or basket will be understood to include all three surfaces, namely the sidewall, the exterior of any central post, and the basket bottom. When the orbital speed is above a certain minimum value, there is a periodic change in the contact force between the load and the sidewall, depending on the frequency and amplitude of orbit, on what part of the orbital circle the basket is traversing and on the inertia of the load. Thus, as the basket sidewall approaches the load, the contact force increases, and as the wall recedes the contact force decreases. This cyclical variable force and the coefficient of friction at the interface between the basket sidewall and the load causes the load to move annularly in a direction opposite to the direction of basket orbit. Basket wall roughness, such as by surface treatment in the form of ribs or otherwise, increases the coefficient of friction and thus increases the energy transfer from the basket wall to the load. This energy transfer manifests itself as a vigorous annular circulation of the load within the basket. Excess liquid in the basket would decrease the effective friction between the fabrics and the basket sidewall and thus would lessen the energy transfer from the basket wall to the load. There is also an internal action between the individual items in the load due to the orbital motion. This interfacial scrubbing, plus the scrubbing occurring at the basket wall to load interface, provides the mechanical washing action on the fabric load.

Since gravity causes the load to be more compacted at the bottom of the basket than at the top, a more vigorous washing action occurs adjacent the basket bottom. Thus, it is preferable to impart a toroidal turnover motion to the load superimposed on the annular motion so as to bring all parts of the load into the bottom area of the basket. This is accomplished in part by providing the basket with a center post having a conical lower section which uses the effect of gravity to move the load outwardly toward the basket sidewall. Spiral vanes are positioned on the conical portion of the post to convert some of the energy of the annular motion to also force the load outwardly toward the basket sidewall. Additionally, inclined ramps are provided along the basket sidewall to engage the fabrics to enhance turnover. With this basket geometry the load moves toroidally while circulating annularly, with the fabrics moving inwardly at the top of the load and outwardly at the bottom. The spiral vanes and ribs on the basket sidewall also provide a certain amount of turbulence to the wash load. The turbulence tends to open the fabric articles so that heavy soil and dirt tend to settle out and to cause movement of the fabrics so that different ones of the fabrics come to the surface of the torus. A limited pool of water at the basket bottom enhances this settling-out or particulate soil removal process.

With this preferred embodiment of the present invention the wash basket orbits and spins within a tub. The tub is a water container which surrounds the basket and is mounted from the machine frame or cabinet by a suitable vibration isolation system. The tub supports the motor, pump and transmission of the machine, with the basket being carried by the output shaft of the transmission. Ideally, this suspension accommodates the described orbital excursion and spin motion of the basket with minimum force transmission to the supporting structure (the washing machine cabinet). The tub and the structure it supports provide the inertial resistance against which the basket acts when orbiting and also provides an unbalanced excursion-limiting, mass during basket spin. Many types of suspension systems known in the art may be used with washing machines incorporating the present invention. It is desirable, however, to suspend the tub structure (including the working machine components) so as to limit any secondary induced motions due to the unbalanced mass of the moving basket so as not to materially affect the orbiting or circulate motion of the basket described above.

A preferred mechanism used to produce the orbital and spin functions consists primarily of an assembly of nested, offset cranks or cylinders. A feature of these mechanisms is the simplicity of having the eccentricity of the parts either add or cancel each other to obtain orbital wash motion or axial spin motion, respectively. The phasing of these eccentricities is obtained by providing a lost motion connection between the eccentric parts which connection is positioned for orbiting or spinning by reversing the direction of rotation of the drive motor. A feature of the illustrative embodiment is that orbiting and spinning of the wash basket is at the same speed. This eliminates the gearing used to obtain the relatively slow agitate function of conventional machines.

As mentioned previously, the volume of water introduced into the wash basket is such as to enhance good washability. The illustrative washing machine is of the fresh-water type in which a small volume of water is added to the basket over a period of time. It flows through the fabric load and basket and exits through holes in the bottom and sides of the basket. At least periodically, water is accumulated so that the lower portion of the basket and fabric load is immersed in a limited or shallow pool of water. This enhances the removal of particulate soil such as sand while still allowing minimal water usage.

The illustrative machine also includes a two-way water input system with a portion of the incoming water being diverted to a detergent dispenser for gradual addition of detergent during the wash operation. The fresh-water, flow-through wash of the machine with gradual detergent addition provides a very effective, high detergent concentration during wash while using substantially less detergent than the standard liquid bath, agitator type washing machines.

DETAILED DESCRIPTION OF THE PREFERRED EMBODIMENTS

General

Figure 1:
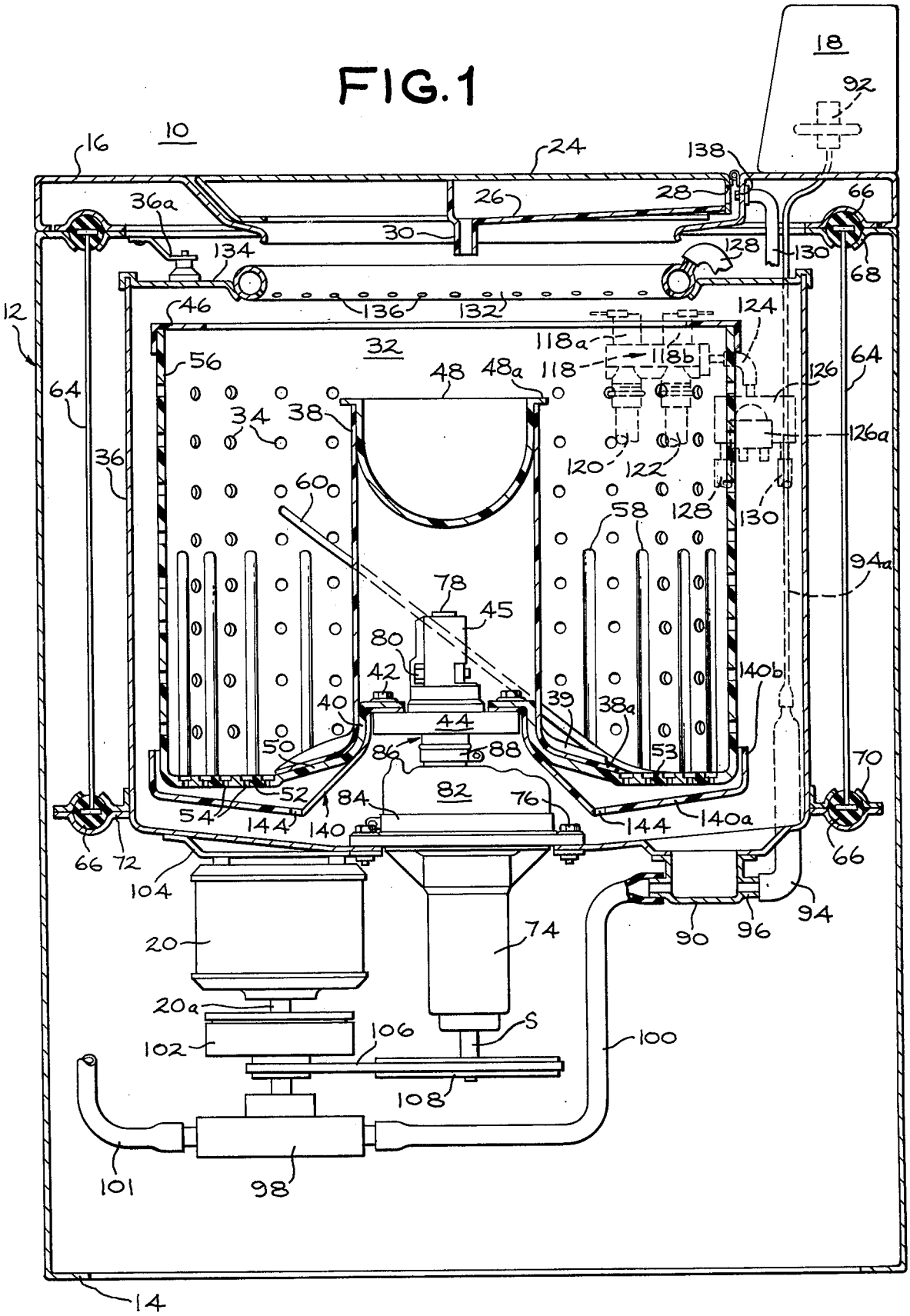
FIG. 1 is a side elevational view, partly in section, of a washing machine in accordance with one embodiment of this invention.

In the following description and in the claims, various details are identified by specific names for convenience. The names, however, are intended to be as generic in their applications as the art will permit. Like reference characters denote like parts in the several figures of the drawings.

In the drawings accompanying and forming part of this specification, certain alternate forms of the invention have been disclosed for the purpose of explanation, but it will be understood that other modifications in these as well as other aspects and details may be made without departure from the broad aspects of the invention.

In accordance with one form of the present invention, and referring to FIG. 1, there is shown a washing machine 10 of the vertical axis type which includes a cabinet 12 having a base portion 14 and a top 16. Such a machine may be supplied with leveling legs for adjusting and leveling the machine to various floor surfaces. They have been omitted for the sake of simplicity. Cabinet top 16 includes a control panel 18 normally provided with a plurality of switches and controls for user control of the operation of the machine.

Cabinet top 16 also is provided with an access lid 24 hinged for movement between a closed position as shown and an open position permitting access to the interior of the washing machine. Lid 24 is provided with a water receiving trough or compartment 26 having a fluid inlet aperture 28 and a discharge spout 30.

The Basket

Figure 2:
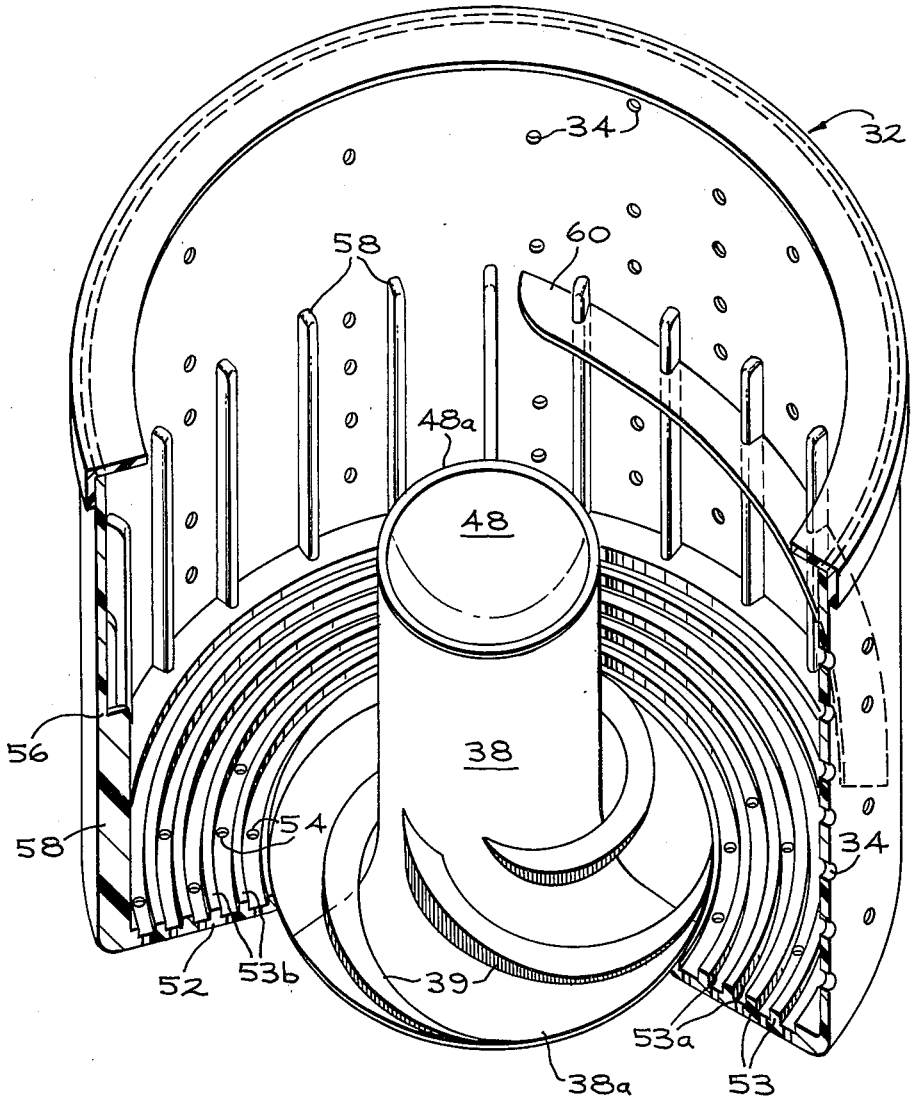
FIG. 2 is a fragmentary perspective view, partly in section, of the wash basket utilized in the washing machine of FIG. 1.

Referring particularly to FIGS. 1 and 2, a single perforate wash basket or clothes-receiving container 32, having perforations 34 formed in its sidewall 56, is disposed within an outer imperforate tub or casing 36. The basket or receptacle 32 receives items such as fabric articles to be washed, as well as the washing medium, usually water. The basket 32 is intended to be rather lightweight and may, for example, be molded from a plastic material such as polypropylene. The basket 32 is of a two-piece construction with the center post 38 being formed separately and attached to an upstanding shoulder 40 of the main part of the basket. It will be understood that the basket can be made in one piece. Post 38 has a cup-shaped receptacle 48 press fitted thereto, the annular rim 48*a* of the receptacle 48 engaging the upwardly extending cylindrical wall of the post 38. Receptacle 48 is adapted to receive and dispense detergent and/or other wash additives.

Basket 32 is mounted to a mounting collar or flange 44 of a mounting hub 45 by means of a plurality of bolts 42. The mounting hub 45, as will be explained hereafter, is driven by the transmission of the washing machine to transmit both orbital and spin motion to the basket.

Basket 32 has three primary wall sections, namely: a conical section 50 which projects outwardly and downwardly from the central shoulder 40, an annular relatively flat bottom section 52 having a plurality of apertures 54 therein, and an outer, generally cylindrical, perforate sidewall 56 extending upwardly from the bottom section 52. The basket 32 may be provided with a suitable stiffening member or retainer 46 around the upper peripheral edge of sidewall 56. In the embodiment shown, the bottom of post 38 has a flared or conically shaped skirt 38*a* which engages conical section 50 of the basket 32. The skirt 38*a* has a plurality of curved or spiral vanes 39 formed thereon. Vanes 39 extend radially outwardly and are sloped downwardly along the conically shaped skirt in a counterclockwise direction, viewed from above, which is the direction fabric articles are caused to move during washing, as will be described in more detail later.

The basket bottom portion 52 includes a plurality of radially spaced apart upstanding annular ribs or rings 53 with the apertures 54 being disposed between the rings 53. Rings 53 serve to allow heavy soil particulates to settle out of the fabric load into troughs 53*a* between the rings and then to drain from the basket 32 through apertures 54. To this end, the upper surfaces 53*b* of the rings elevate the fabrics to prevent the fabric articles from blocking the apertures 54.

Outer sidewall 56 is shown as cylindrical and substantially vertical although other forms of the wall 56 could also be used. For example, the sidewall could be tapered inwardly from bottom to top in the general shape of a frustrum of a cone. Sidewall 56 is provided with a plurality of vertically extending ribs 58 which protrude radially inwardly. Ribs 58 serve to impart a substantial annular motion to the fabric load in a direction opposite to the direction of basket orbit. As the axis of the basket orbits about a vertical axis offset therefrom, the axis of the basket substantially traces a vertical cylinder and each point of the basket moves in a substantially circulate path. The distance by which the axis of the basket is laterally offset from the vertical axis is much smaller than the radius of the basket and those portions of the sidewall 56 adjacent the fabric load repeatedly impact the fabric load, move away from and again impact the fabric load. The repeated impacts cause the fabrics to move annularly around the inside of the basket in a direction opposite to the orbital movement of the basket. The ribs 58 enhance the driving effect of the wall impact with the fabrics. Of course, other means to provide frictional or surface roughness on the basket inner sidewall such as, for example, a plurality of bumps thereon also could be employed to enhance the driving engagement of the wall 56 with the fabric load. Any such friction enhancing means preferably has a radial dimension less than the orbital excursion amplitude so that the sidewall 56 will break driving contact with the fabrics.

A plurality of vanes 60 are formed or mounted on sidewall 56 projecting inwardly into the basket and are inclined relative to the bottom 52 in the direction the fabric articles are caused to move, in this case counterclockwise, to help cause the fabric load to roll or turn over in a toroidal manner. The vanes are wider, i.e. protrude further into basket 32 than ribs 58, to create the rolling or turning of the fabrics and also to create turbulence in the liquid and fabric load. This turbulence tends to break up the toroid of fabrics so that more of the total fabric surface is exposed to the interfacial scrubbing action of the basket and the inner-fabric scrubbing action is enhanced as well, all assisting achievement of uniform washing.

As previously pointed out, the outer basket wall 56 provides the predominant mechanical washing energy to the fabric load. The amount of the sidewall involved in the washing process is essentially directly proportional to the size of the fabric load. That is, as more fabrics are washed, the load in the basket is deeper, and more of the sidewall is involved. Therefore, the per unit energy input to the fabrics remains generally constant regardless of load size. In prior art machines, the per unit energy input is higher for small loads unless complicated and expensive remedial actions, for example multi-speed drive mechanisms and multiple agitators, are utilized.

In a basket having: a diameter of approximately 21.5 inches, a basket bottom portion 52 having a radial dimension of approximately 5 inches, a conical section 50 having a slope of about 15° degrees, ribs 58 having a radial width of depth of approximately 0.25 inches and three vanes 60 having a radial width or depth of approximately 2 inches and a developed length of 14 inches inclined at an angle of about 30° from bottom portion 52, which basket is orbited at about 600 rpm through an excursion of $\frac{3}{4}$ of an inch, fabric turnover, both annular and toroidal, has been found very effective for a large range of fabric load sizes.

It has also been found that with a $\frac{3}{4}$ inch excursion and with a basket of the above dimension an orbiting speed of less than 500 rpm does not provide adequate annular fabric rotation. As the orbiting speed increases, the annular speed of rotation of the fabric load also increases, as does the rate of fabric turnover. The orbiting speed of 600 rpm provides very effective annular and toroidal movement. A spin speed in the range of 600 rpm provides desirable water extraction with acceptable machine vibrational characteristics. An orbit or spin speed of approximately 700 rpm induces undesirable resonant vibrational movement and resultant noises in certain flooring presently permitted by many residential building codes. Thus, an orbiting speed of about 600 rpm does not require any motor/transmission speed changes between wash and extraction operations. This eliminates the need for complex and expensive gearing as found in many well known prior art machines.

THE SUSPENDED SYSTEM

Tub 36 is suspendedly mounted to the cabinet 12 by three rods 64 which are fixed to resilient spherical members 66. The spherical members in turn are secured to sockets 68 and 70 formed in a cabinet 12 and in a retaining support member 72 attached to the tub 36, respectively. Only two rod and socket combinations are fully shown in FIG. 1, but it will be understood the other rod and socket combination is identical, and the rod and socket combinations are spaced 90° apart around the tub 36 and disposed in three of the corners of the machine cabinet. A transmission or washer drive mechanism 74 is positioned in an opening in the tub 36 which is concentric with the vertical axis of the tub 36 and is secured to the tub by a plurality of bolts 76. Basket 32 is mounted on collar 44 by bolts 42, and hub 45 of the collar is mounted on the transmission output shaft 78 by two bolts, one of which is shown at 80, and a clamping bar 81.

A sump 90 is secured in an opening of the bottom of tub 36 to receive washing liquid flowing from basket 32. A water level switch 92, which may be of a type well known in the art, is mounted in a control panel 18. An air chamber 94 is connected to nipple 96 of sump 90 and a hose **94*a* connects the air chamber to switch 92. As water accumulates in sump 90, the air in chamber 94 is compressed and switch 92 is closed. Basket 36 is driven through transmission 74 in response to operation of a reversible motor 20 through a system including a suitable load-limiting clutch 102 mounted on the motor shaft 20*a*. Shaft 20*a* also supports and drives pump 98 as is customary in the art. Motor 20 and the structure supported thereby are suitably mounted to tub 36 by mounting member 104. A suitable belt 106 transmits power from clutch 102 to the input shaft S of the transmission assembly 74 through a pulley 108. Thus, depending upon the direction of motor rotation, pulley 108 and therefore input shaft S of transmission 74 is driven in opposite directions. When motor 20 is rotated in one direction, the transmission causes the central axis of basket 32 to orbit about the axis of input shaft S in a substantially horizontal plane. Conversely, when motor 20 is driven in the opposite direction, the transmission aligns the axis of basket 32** with the axis of the input shaft S and rotates the basket at a high speed for centrifugal liquid extraction. Illustrative embodiments of transmission or drive mechanisms for selectively providing orbiting and spinning motion of the basket will be explained in more detail subsequently.

Pump 98 is connected to sump 90 by a hose 100 for withdrawing water from tub 36. Pump 98 is formed so that, in either direction of motor rotation, pump 98 will draw liquid from sump 90 through hose 100 and discharge it through hose 101 to a suitable drain (not shown). The particular form of the pump assembly 98 is not significant so long as the pump withdraws liquid from the tub in response to motor rotation in either direction.

It should be noted that with use of the suspension system as shown and described, the motor 20, clutch 102, transmission 74, tub assembly 36 and basket 32 are all suspended and supported from the cabinet 12 by rods 64. During orbital operation, there are action and reaction forces between the basket 32 and transmission 74. If the mass of an unloaded basket 32, on the one hand, and the mass of the tub 36 and the other components carried by it (such as the motor 20, clutch 102, pump 98 and transmission 74, for instance), on the other hand, were equal, the orbital excursion would be divided approximately equally between the basket and the tub structure. Conversely, as the mass of the suspended structure increases relative to the mass of basket 32, the orbital excursion of the basket increases. Thus, the tub structure (the tub and other components supported by it) is constructed to have substantially greater mass than the mass of the basket and most of the orbital excursion is by the basket. The tub structure moves very little during orbital operation, and the suspension, including rods 64 and resilient spheres 66, tends to isolate even this movement from the cabinet 12. Thus, there is very little vibration of the cabinet. It has been found with a basket having the general dimensions noted above, the actual excursion of the basket measured from a fixed reference point decreases slightly as the fabric/liquid load increases due to the limited relative movement of the suspended structure. This slight decrease in orbital excursion does not have a significant effect on washing performance.

In the illustrated embodiment, during spin extraction, the basket 32 is rotated about its geometric center. The mass of the water is quickly removed and the mass of fabrics will affect the center of gravity of the mass of the rotating basket. If the mass of the fabrics is evenly distributed in the basket, there will be very little vibration. However, as often occurs, uneven fabric distribution will result in vibration by the basket. The mass of the non-rotating parts of the suspended system, that is the tub structure, resists such vibrations, i.e., the tub structure resists moving. Since the mass of the tub structure is large compared to the mass of the basket, the tub structure has only a small amount of vibration, which is further isolated from the cabinet 12 by rods 64 and resilient spheres 66. The effect of the tub structure can be enhanced by increasing its mass such as, for example, by simply mounting a weight like a body of concrete to the tub 36.

The suspended system of machine 10 is a pendulum system and has a resonant frequency, typically about 120 rpm. As the motor 20 and transmission 74 accelerate the basket through the resonant frequency, a small unbalance can cause a very large movement of the suspended system. A frictional damper such as that shown at **36*a*** facilitates passage through the resonant frequency. A number of friction damper structures known in the art can be used for this purpose.

Although the rod-type suspension is shown, it should be understood several other suspension systems may be used with machines incorporating the present invention, provided the tub and working components are incorporated in the "moving" system as described above. That is, since the tub and the structure it supports provides the inertial resistance against which the basket acts when orbiting and also provides an unbalance, excursion-limiting mass during basket spin, the suspension system should accommodate the orbital excursion and spin motion with minimum force transmission to the supporting cabinet. The tub and other suspended working components should be suspended so as to limit any secondary induced motion due to the unbalanced mass of the moving basket so as not to adversely affect the orbiting or "circulate" motion of the basket.

For purpose of description herein the term "circulate" is used. This term generally shall mean to move in an orbit along a substantially closed path. It is to be understood, however, that other induced motion of any particular suspension system may be slightly elliptical and may move slightly vertically and therefore lie within a locus of points describing a torus. Also, any rotation or precession of the basket during orbit will mean the path of any point on the basket will not exactly close upon itself. Therefore, the term "circulate" is intended to encompass all of these limited motions.

Regardless of the suspension used, however, the central axis of the basket will always be caused to move in a predetermined path about and spaced a predetermined distance from a predetermined axis which, in the preferred embodiment, is the axis associated with the input shaft of the transmission about which the basket is orbiting.

One form of suspension that may be used is that known as a "fixed node" suspension such as that shown and described in U.S. Pat. Nos. 2,854,297 and 2,930,215, for example. The fixed node suspension provides an invaginated dome-like base mounted at the bottom of the machine cabinet and capable of supporting a drive shaft in a vertical position. The dome-like structure serves as an anchoring means for the assembly supporting the shaft and permits relatively limited nutational movement of the shaft about a vertical axis. A variation of this suspension is shown in U.S. Pat. Nos. 3,247,689 and 3,277,742.

As noted above in the discussion of the Suspended System, it is contemplated that the basket may slightly move vertically during its circulate motion. In a washing machine constructed to have a suspension system substantially in accordance with FIG. 1 and a basket configuration substantially in accordance with FIGS. 1–2, satisfactory turnover of the fabric article load was obtained. The basket had a slight vertical movement with respect to the ground due to movement of the suspension. In the testing of machines incorporating the present invention and utilizing other basket configurations, it has been found that at least in some instances slight vertical movement of the basket is desirable to aid the turnover of the fabric article load. A machine with a "fixed node" suspension of the general type described above, and utilizing the Alternate Transmission, described below, was used in testing other basket configurations, including a preferred basket configuration in which a series of annular ledges were formed on the flared skirt 38*a* of point 38 in place of the spiral vanes 39. Each of the ledges had a number of spaced apart apertures and an upstanding lip along its outer edge. The rings 53 were removed and the ribs and vanes were of somewhat different configurations than shown at 58 and 60 respectively. Good turnover of fabric article loads was achieved with that machine. A presently preferred basket which includes such features is described in copending application of Everett D. Morey and Eddie W. Dooley, Ser. No. 172,092, filed July 25, 1980, and assigned to the assignee of the present invention. When baskets of that configuration were installed in other fixed node suspension machines utilizing the Alternate Transmission, turnover of fabric article loads in some of those other machines was not as good as in the fixed node suspension machine first described above, and in some such machines acceptable turnover was not achieved. It was found that in the first-described fixed node suspension machine utilizing the Alternate Transmission, the crankshaft H (see FIG. 9) was, through inadvertence, made such that upper shaft 310 and lower shaft 316 deviated slightly from parallelism of their axes. This caused the circulate movement of the basket to include a small vertical component which facilitated movement of the lower part of the fabric load across the flared skirt and basket bottom during toroidal turnover of the load. The lack of parallelism of the axes of the shafts was found by Gerald L. Roberts and a washer construction including a preferred manner of having the axis of the upper shaft of crankshaft H slightly canted radially outwardly, on the order of one degree, and in a direction such that the projection of the canted axis of the upper shaft into a plane normal to the axis of the lower shaft lags the lateral offset of the axis of the upper shaft relative to the direction of movement of the axis of the upper shaft in the washing operation by about thirty degrees, is described in his copending application, Ser. No. 203,208, filed Nov. 3, 1980, and assigned to the assignee of the present invention. The slightly canted axis, when used with the above-described Morey and Dooley basket configuration and a fixed node suspension, provides good turnover of the fabric article load. The present application is intended to cover washing machines incorporating the present invention wherein the circulate motion of the basket includes a slight vertical movement irrespective of the structure causing it.

Fluid System

Washing machine 10 is a fresh-water flow-through machine. The machine includes water supply means in the form of a solenoid-operated, mixer valve 118 (shown in phantom) having solenoids 118*a* and 118*b* and coupled to sources of hot and cold water, such as household faucets, through hoses 120 and 122, respectively. By selective energization of the solenoids 118*a* and 118*b*, hot, cold or warm water will be provided at the output of valve 118. The output of mixer valve 118 is fed through a conduit 124 to a solenoid diverter assembly 126 having a solenoid-operated control valve 126*a*. When valve 126*a* is de-energized or closed, all of the water entering assembly 126 is fed to hose 128. When valve 126*a* is energized or open, the flow from assembly 126 is divided between hoses 128 and 130 in a predetermined ratio such as, for example, 4:1. Hose 128 is connected to a fill ring 132 which is secured to an annular mounting frame 134 which, in turn, is suitably mounted to the upper extremity of tub 36. Fill ring 132 is a continuous hollow annular tube having a plurality of apertures 136 formed therein so that water from hose 128 will spray downwardly all around the inside of basket 32.

Hose 130 is connected to a fluid nozzle 138 which is fastened to an aperture formed in the cabinet top 16. Nozzle 138 is in juxtaposition to aperture 28 formed in lid 24 to supply water to trough 26. Output from the trough 26 is discharged from the spout 30 into the dispensing receptacle 48 for mixing with the detergent liquid or granules which have been placed therein.

The water sprayed from ring 132 wets the load of fabrics in the basket. After the fabrics are wet to a degree that water soaks through, water will pass through the items being washed and thence through the perforations 54 at the tub bottom 52. The water and any sand and/or other soil particulates carried by the water pass into an annular pan 140 disposed beneath basket 32. Pan 140 is connected to the mounting collar 44 by the bolts 42. Pan 140 has an annular upwardly inclined bottom portion 140*a* which slopes toward the central axis of the machine 10 and a vertically extending outer lip 140*b* which rises slightly higher than the substantially horizontal bottom section 52 of tub 32. Pan 140 serves to form a shallow or limited liquid bath at the bottom of basket 32 relative to the basket's vertical dimension, thereby at least periodically completely covering the bottom 52 of basket 32. In the exemplification basket 32, having the dimensions previously described in detail, as lip 140*b* is overlapping the bottom portion of basket 32 sufficiently to provide a pool having a depth of approximately 1 inch has been found to be satisfactory.

The turnover or torodial movement of the fabric load results in each fabric becoming immersed in this fluid bath from time to time. Immersion of the fabrics enhances removal of particulate soil such as sand. Pan 140 also includes a plurality of apertures 144 disposed adjacent the radially inward terminus of the inclined portion 140*a*. The water, along with the particulate and other soil carried by the water, passes through the apertures 144 of the pan 140 into the lower portion of tub 36 and the sump 90. The water, and entrained soil, is pumped from the sump 90 by pump 98 and is discharged through pump discharge hose 101. It will be understood that apertures 145 are sized so that the flow of the water through apertures 145 is less than the flow through apertures 54 so that water will accumulate in pan 140 to a level which at least periodically overflows lip 140*b*.

A typical clothes washing operation proceeds as follows. The clothes to be washed are placed within the basket 32 and the desired amount of detergent is placed in receptacle 48. The operator chooses the appropriate washing cycle times and water temperatures and turns on the machine 10. First, there is an initial wet-down or soaking of the fabric articles in basket 32 by the flow of water from the fill ring 132 without any flow of water from trough 26. This action thoroughly wets the clothes and prepares them for washing without using any detergent. When the clothes are thoroughly soaked, water will drain through the basket bottom 52 into pan 140 and thence through apertures 144 into sump 90. As the water collects in sump 90, pressure switch 92 is activated and energizes motor 20 which, in turn, causes transmission 74 to move the basket 32 in its orbital or washing mode, as will be described in more detail hereafter. Motor 20 includes a centrifugal switch which closes when the motor starts rotating. Thus, even though the water is pumped from sump 90 thereby resetting pressure switch 92 during the wash operation, the motor will continue to run. Closing of switch 92 also results in the energization of valve 126*a* so that the flow of water is divided between ring 132 and trough 26. The water directed to trough 26 flows from spout 30 into the detergent receptacle 48 where it mixes with the detergent in receptacle 48 and, due to the motion of the basket, is ejected from the receptacle 48 and mixes with the clothing in a diluted form.

As machine 10 is of the flow-through type in which the fabrics are washed by a small, constantly changing amount of water, it is desirable to provide fresh water to the basket at a rather slow rate. In an exemplification machine, an effective rate of one-half gallon per minute has been found acceptable. It is difficult to get economical solenoid water valves which will accurately control a continuous flow at that low rate. Thus, in the exemplification, the effective flow is obtained by pulsing the water supply. That is, water is supplied at the rate of two gallons per minute for fifteen seconds once each minute throughout the wash process, which may be variable in length. A pulsed flow has another advantage. When water is being supplied a pool of water builds up in pan 140 and immerses fabrics in the lower portion of basket 32. When the water flow is interrupted, that pool of water drains into sump 90. Pump 98 exhausts the water from the machine and the water carries with it much of the scum, soil and particulate matter which had been removed from the fabrics. This removal process is repeated with each pulse of water, enhancing the washing action.

Since the detergent is added gradually and only a small amount of water is in a machine embodying my invention at any one time, a very effective concentration of detergent is maintained in the wash water with an overall detergent usage substantially less than with prior art deep water bath machines.

At the conclusion of wash, there is a centrifugal extraction of the wash water. To accomplish this, the direction of rotation of motor 20 is reversed. This causes transmission 74 to align the axis of basket 32 with the main drive axis S of the transmission and to rotate the basket at high speed about this axis. The pump 98 removes the centrifuged water from the machine.

The rinse process following the centrifugal extraction of the wash water is very similar to the wash process with orbital movement of the basket, but often with a change in the water temperature selection. In rinse, the flow normally will be through the fill ring 132 only, either in a continual or pulsed fashion continuing throughout the rinse process. Upon conclusion of the rinse portion of the cycle, the water flow is terminated and the machine enters another centrifugal water extraction or basket spin mode of operation such as described above.

Of course, more than one washing and/or rinsing operation may be provided, if so desired. A number of other modifications may be made to the cycle such as the addition of spray rinses during the spinning operation. Other steps can be provided such as, for example, a fabric loosening operation in which the basket is orbited without addition of water after the last centrifugal extraction to loosen the fabrics which will have been pressed against the sidewall by the centrifugal extraction.

It will be understood that other flow rates and other pulse times, or continuous low level flow, can be utilized with machines incorporating my invention. For example, a cycle of operation could include a wash step beginning with a high flow rate (for instance about three gallons per minute) wet down of the fabrics; followed by about five minutes of orbital movement accompanied by water input at a low rate (for instance about 0.7 gallon per minute) during which detergent is added; followed by about five minutes of orbital movement without water addition; followed by a final five minutes of orbital movement with low flow rate water addition and no detergent addition. After a spin and fluff step a rinse step could include a high flow rate wet down followed by about four minutes of operation with low flow rate water addition. The cycle could end with another spin and fluff step.

It will be recognized that the water used for each wet down varies with the size of the load and the type of fabrics being washed; fabrics of blended materials absorbing less water than cotton and purely synthetic fabrics absorbing less than blended materials. Thus the water usage will vary somewhat from machine to machine and load to load. However with a machine of the size and general operation as described above, the last described wash cycle would use about twenty gallons of water to wash eight pounds of cotton fabrics.

By way of comparison, deep bath agitator type washing machines currently marketed in the United States, when set for water levels appropriate to wash an eight pound load typically use between about thirty-five and about forty-five gallons of water. The actual amount varies from manufacturer to manufacturer and with the size of the machine.

The prescribed washability test of the Association of Home Appliance Manufacturers (AHAM) provides for the use of 6 grams of standard detergent per gallon in the wash bath. The amount of water in the wash bath of currently available agitator machines varies from manufacturer to manufacturer. In the current agitator machines made by the assignee of the present invention the bath is about twenty-three gallons. This equates to about one cup of AHAM detergent for the AHAM test. With the flow through type washing action of the preferred embodiment of the present invention the amount of water in the "wash bath" is about ten and one-half gallons, on the basis that all water supplied to the machine prior to the rinse step constitutes "wash bath" water. When using a washing cycle generally as last described above in a machine incorporating the present invention with three-quarters cup of detergent, washability results are very favorable in comparison with AHAM test results obtained with various commercially avaialable deep bath agitator washers. Further, on the basis that all "wash bath" water supplied to a machine embodying the present invention is supplied solely as hot water, it is readily apparent that a machine embodying the present invention effects a significant energy saving in comparison with typical deep bath agitator machines currently marketed in the United States.

The Transmission

Referring now to FIS. 3 through 5, one embodiment of a transmission or drive mechanism 74 for use in the machine 10 is shown. The three primary rotary drive elements are shown bracketed in FIG. 4 as elements or assemblies "A," "E" and "F." The transmission has an output shaft 78 which drives the basket 32 in an orbital mode for wash and rinse and in a rotary mode for spin. The output shaft 78 is moved eccentrically of the input shaft of the transmission for the orbital action and rotates with and on the same axis of the input shaft for the spin action.

Referring more particularly to the exploded view of FIG. 4, the transmission 74 will be described in its order of assembly, commencing at its output or upper end. The rotary drive element or assembly "A" includes the vertical output shaft 78, having a radially extending collar **78*b*, a splined axial extension 78*c* and a circumferential groove 78*d* formed thereon by suitable machining techniques. A coupling assembly designated generally by the bracket "B" is assembled to shaft 78 to permit eccentric motion of the shaft 78 relative to the transmission housing 256 (See bracket F) in order to orbit the basket 32. The assembly B, of the type known as an "Oldham" coupling, consists of an upper plate 170, a center plate 176, and a lower plate 180. The upper and lower plates 170 and 180 may be fabricated from, for example, sintered iron, and the center plate may be fabricated from a low friction material such as that sold under the tradename Delrin by DuPont. Upper plate 170 has a radially inner, downwardly extending, internally splined collar 172 engaging splined axial extension 78*c* of shaft 78. Collar 78*b* of shaft 78 rides on the upper surface of plate 170. A pair of opposed, radially extending engagement members or ribs 174 protrude downwardly from plate 170. Center plate 176 has an oval opening 176*a* formed therein which receives collar 172 and allows lateral movement of collar 172 within plate 176. Center plate 176 includes two sets of diametrically opposed, radially extending slots 177 and 178, respectively. The slots are spaced apart 90 degrees, one set from the other. Slots 177 are formed in the axial upper face of plate 176 to receive engagement members 174, and slots 178 are formed in the axial bottom face of plate 176 for receiving engagement members or ribs 182 which extend axially upward from the top surface of lower plate 180. Plate 180 also has a downwardly extending cylindrical sleeve 184 having a plurality of splines 186 formed on its outer surface. During the wash and rinse steps, the output shaft 78 is moved about an axis offset from its own axis by elements of the transmission to be described below. The Oldham coupling permits this motion while preventing rotation of the shaft 78** about its own axis.

It will be appreciated that if lower plate 180 is held stationary while the shaft 78 and therefore the splined upper plate 170 is moved about an axis offset or eccentric to the axis of lower plate 180, center plate 176 will move back and forth relative to lower plate 180 on the engagement of members 182 with slots 178 and upper plate 170 will move back and forth relative to center plate 176 on engagement of members 174 with slots 177. This allows the shaft 78 to orbit about an axis offset from its own axis while restraining the shaft 78 from rotating about its own axis. Conversely, if lower plate 180 is not held in a stationary fashion, the entire coupling assembly B will rotate with the shaft 78.

The next portion of the transmission 74 to be assembled to shaft 78 is the clutch mechanism generally designated by the bracket "C". This clutch mechanism connects shaft 78 to its driving member, described below, for rotation therewith in the spin mode and permits relative movement between shaft 78 and its driving member in the orbital mode. A convoluted spring washer 188 is placed over shaft 78 into engagement with the bottom extremity of axial extension 172 of upper coupling plate 170. A splined clutch thrust washer 190 is received on splined extension **78*c* of shaft 78 adjacent to washer 188. A friction clutch lining member 192 is placed on the other side of thrust washer 190. Clutch liner 192 has a plurality of radially extending outer splines 194 formed thereon for engagement with mating slots 202 formed in a radially inner surface of an upwardly extending axial extension 204 of an upper eccentric sleeve 206 (See bracket E). A splined steel clutch disc 195 engages splined extension 78*c* of shaft 78 and another clutch liner 192 completes the illustrated clutch assembly. It will be understood that additional clutch liners 192 and clutch discs 195** may be used if desired.

A brake assembly generally designated by the bracket "D" is used to hold lower plate 180 of the Oldham coupling stationary during orbital movement of shaft 78. The brake assembly consists of a plurality of friction material brake liner members 196, and steel brake discs 198 stacked in an interleaved fashion. While only two liners 196 and one disc 198 have been illustrated, it will be understood that additional such members can be used in an interleaved array. Each brake disc 198 has a plurality of radially extending slots 199 formed in its inner edge for mating with splines 186 on the sleeve 184 of lower plate 180, and each brake liner 196 has a plurality of radially extending slots 197 formed in its outer edge for engagement with mating splines **256*a* formed on the radially inner surface of an axial flange 256*b* of transmission housing 256 (see bracket F). The uppermost brake liner 196 engages the bottom annular surface of lower plate 180 and the lowermost brake liner 196 engages an annular shoulder 256***c* formed in housing 256. When the significant downward force component on shaft 78 (resulting from the weight of the basket, etc.) is transmitted through collar 78*b* and the coupling plates 170, 176 and 180 to brake assembly D, the liners 196 and discs 198 are forced together and will not move relative to each other. Since the liners 196 are splined to stationary transmission housing 256 and the discs 198 are splined to lower coupling plate 180, this restrains plate 180 from rotating. When the significant downward force is removed the liners 196 and discs 198 can move relative to one another and plate 180 can rotate.

A rotary drive element or assembly for transmitting both orbital and spin motion to output shaft 78 is generally designated by bracket E and will be referred to as the inner eccentric assembly. Inner eccentric assembly E includes an upper eccentric sleeve 206, a drive tube 216 and a lower eccentric sleeve 220. Upper eccentric sleeve 206 has a cylindrical section 204 having a plurality of slots 202 formed in its radialy inner surface, for mating with clutch splines 194 of clutch liner 192, as noted above. Section 204 extends axially upwardly from a radially extending, cylindrical flange 207. A radially inner and a radially outer arcuate tab 208 and 209, respectively, project downwardly from flange 207 (see FIG. 6). Upper eccentric sleeve 206 also has an axially downwardly extending cylindrical section 210 radially inward of inner tab 208, the circumferential surface thereof comprising a bearing surface. A bore 212 extends through sleeve 206 for receiving shaft 78. The axis Z—Z of the bore 212 is offset or eccentric to the axis Y—Y of the bearing surface formed by section 210. The cylindrical section 204 which interacts with clutch C is concentric about axis Z—Z.

Drive tube 216 has an axially extending upper section 216*a* having a flattened area 216*b*. Tube 216 is mounted in bore 212 with flat 216*b* aligned with a flat 212*a* of the bore 212 and is preferably permanently connected thereto as by welding. Sleeve 216 also has an axially extending lower section 216*c* with a flat for mating receipt in a flattened bore 221 of a lower eccentric sleeve 220. Sleeve bearings 218 and 219 are press-fitted to the upper and lower openings, respectively, of drive tube 216 for rotatably supporting shaft 78.

Lower eccentric sleeve 220 is a cylindrical member, with an outer diameter equal to the outer diameter of cylindrical section 210 of the upper eccentric 206, and its outer surface also serves as a bearing surface. The inner eccentric assembly E is mounted to shaft 78 by aligning the clutch liner splines 194 with slots 202 of sleeve 206 and inserting shaft 78 through tube 216. The completed assembly with coupling B, clutch C and brake D positioned around the shaft is secured by thrust washer 222 and snap ring 224 received in an annular groove 78*d* of shaft 78.

The third and final main rotary drive element or assembly of the transmission 74 is generally designated by the bracket "F," assembly F being the input drive (including shaft S of FIG. 1) connected to the drive pulley. For purposes of description, assembly F is referred to as the outer eccentric assembly. Outer eccentric assembly F includes a generally cylindrical upper eccentric member 232, which can be seen in more detail in FIG. 6, a drive tube 240 and a lower eccentric member 244. The main axis of the outer eccentric assembly is designated as X—X. The upper eccentric member 232 has a bore 233 with an axis Y—Y which is offset or eccentric to the input shaft axis X—X. Drive tube or sleeve 240 has an axial extension 240*a* press-fitted in and welded to bore 233 of upper eccentric member 232. The downwardly extending cylindrical sections 210 of upper eccentric sleeve 206 and lower sleeve 220 of assembly E are received in a bore 241 of drive tube 240. Thus, axis Y—Y is the axis of upper and lower eccentric sleeve 206 and 210 and drive tube 240. Drive tube 240 has an annular groove 240*b* formed in its inner surface at its lower end for receiving lower eccentric member 244 which is welded to sleeve 240. Lower eccentric 244 has an eccentric mounting section 244*a* centered on axis Y—Y. The axis of bearing support hub 244*b* and axially extending shaft 244*c* is centered on axis X—X of shaft 244*c* used for mounting to pulley 108 (not shown). The axis of shaft 244*c* is the same as the axis of the upper eccentric member 232 of assembly F, namely X—X.

The inner eccentric assembly E is inserted into drive tube 240 of outer eccentric assembly F and pin 246 is inserted into aperture 242 in drive tube 240. Pin 246 projects into tube 240 between cylindrical section 210 and lower eccentric 220 of inner assembly E. This provides inner eccentric assembly E (see FIG. 3) with a controlled amount of axial movement relative to outer eccentric assembly F. The completed transmission assembly is inserted into the transmission housing 256 with the brake liner slots 197 aligned with the splines 256*a* of housing 256. A main housing bearing 250 is inserted between housing 256 and an outer bearing surface of upper eccentric 232 of outer assembly F. Ball bearing assembly 252 is positioned between housing 256 and support hub 244*b* and is held in place in housing 256 by two snap rings 254 and 255 secured to the support hub 244*b* of outer assembly F and the housing 256, respectively.

The purpose of the transmission 74, as already noted, is to drive the shaft 78 in two different modes, i.e., an orbital washing mode and a spin extraction mode. In both of these modes, the shaft 78 is driven by input torque supplied to the input shaft 244*c*. For the orbital mode, the transmission offsets or shifts the axis of the output shaft slightly from the axis of the input shaft whereas, for the spin mode, the transmission aligns the axis of the input and output shafts. The switching between the two modes, i.e., the aligning or offsetting of the output shaft and the input shaft is accomplished through relative motion between the inner and outer assemblies E and F, respectively. The manner in which this relative motion is accomplished may be best understood by referring to FIG. 6.

Figure 5:
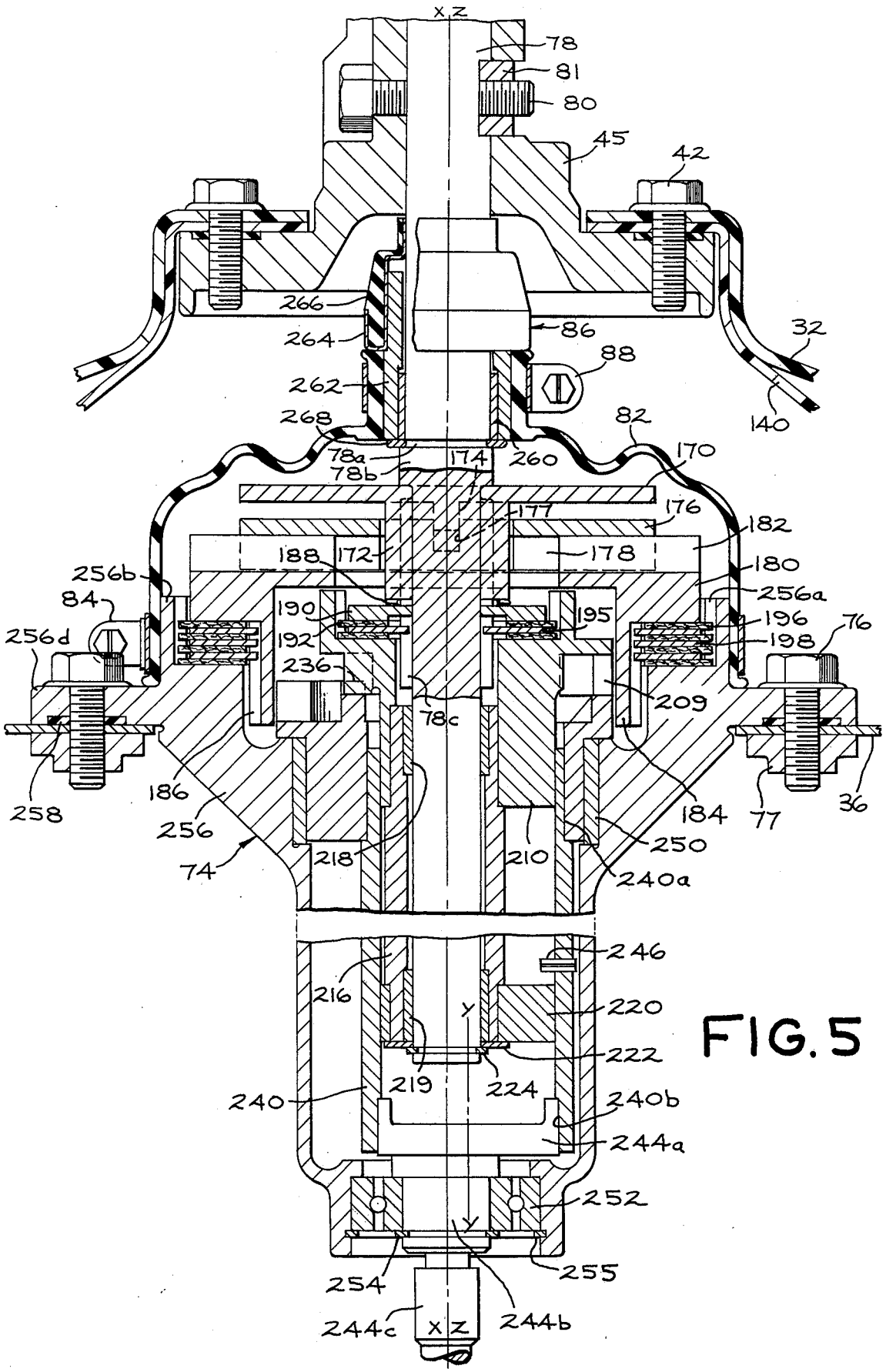
FIG. 5 is a cross-sectional view of the transmission similar to FIG. 3 but illustrating the relative position of the parts when the machine is in the spin drying mode of operation.
Figure 6:
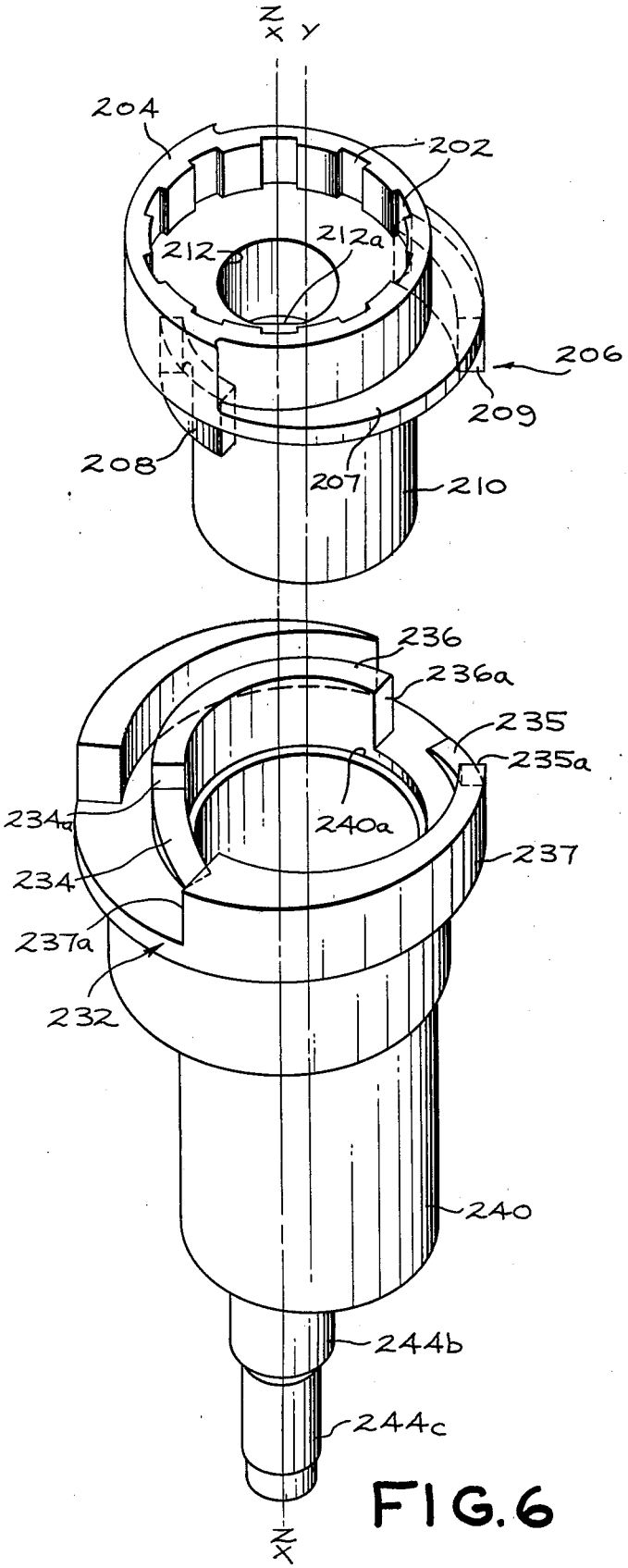
FIG. 6 is an exploded, somewhat enlarged, perspective view of parts of the drive mechanism of FIG. 4, illustrating the relative angular position of those parts when in the spin drying mode of operation, as seen in FIG. 5.

Referring to FIG. 6, the upper eccentric sleeves 206 and 232 of the inner and outer eccentric assemblies E and F, respectively, are shown in an exploded perspective view. Upper eccentric 232 of assembly F is shown rotated approximately 180° from the position shown in FIG. 3 to correspond to its relative position shown in FIG. 5. Note that in this position the axis Z—Z of shaft 78 is aligned with the main axis X—X of the outer eccentric assembly F, thereby aligning the input and output shafts of the transmission for the spin mode. For purpose of description, the positions of inner and outer eccentric assemblies E and F shown in FIG. 3 will be referred to as their first relative angular positions and the positions of eccentrics assemblies E and F shown in FIG. 5 will be called their second relative angular positions. In the first relative positions, the transmission produces the orbital motion and, in the second relative positions, produces the spin motions. To accomplish moving the shaft between these modes, an inner and an outer arcuate axially extending section 236 and 237, respectively, are provided on member 232. The sections 236 and 237 project upwardly from member 232 and are concentric about the axis Y—Y. The downwardly projecting tabs 208 and 209 of inner eccentric member 206 also are concentric with axis Y—Y. Tab 208 is positioned to be engaged by cam 234 and driving surfaces 234*a* and 236*a* of section 236. Tab 209 is positioned to be engaged by cam 235 and driving surfaces 235*a* and 237*a* of section 237 of member 232.

Figure 3:
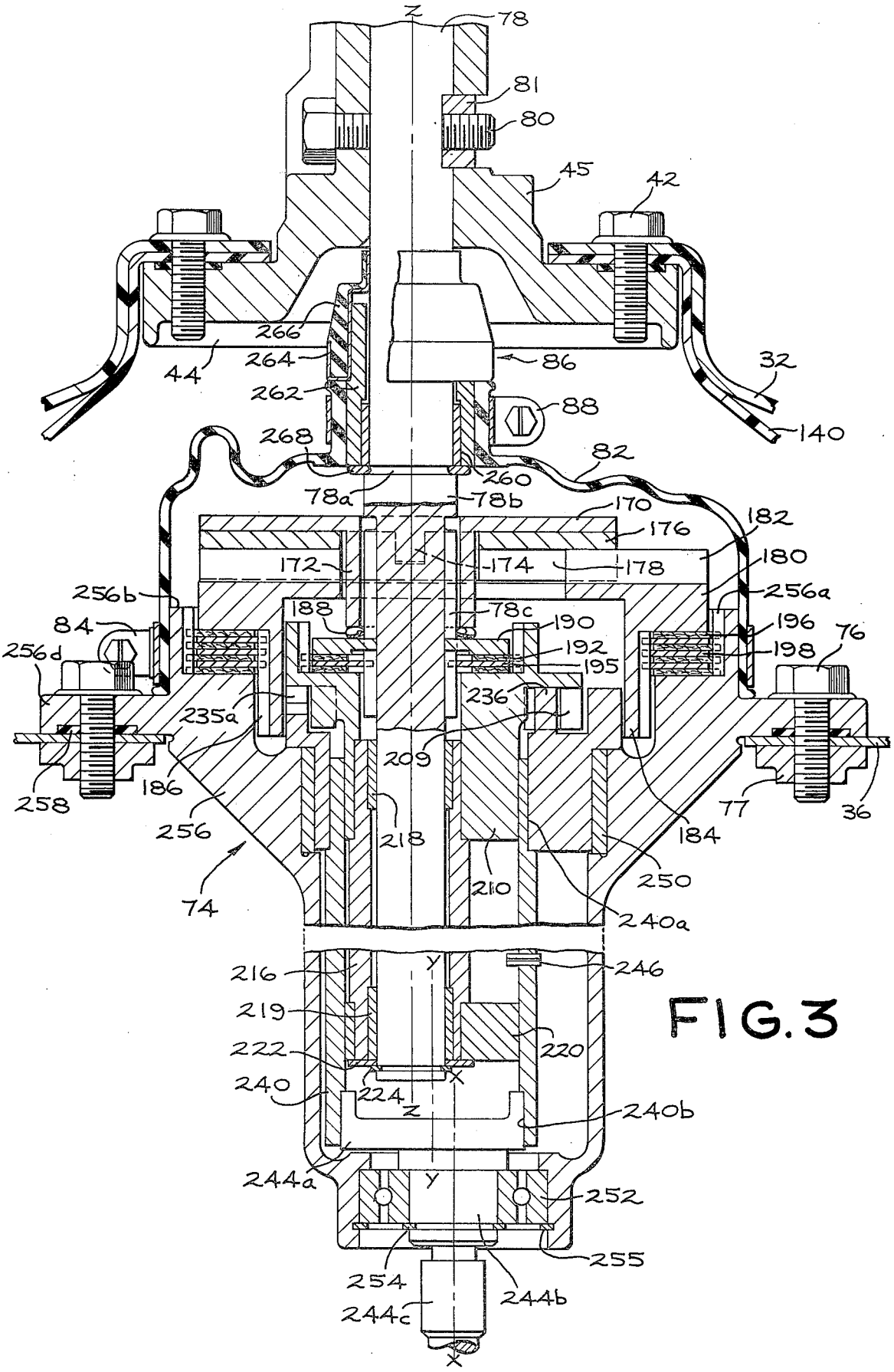
FIG. 3 is a cross-sectional view of the transmission mechanism in accordance with one form of the present invention, the view being somewhat simplified for clarity and the relative position of the parts shown as when the machine is in the washing mode of operation.

When eccentrics E and F are in their first relative angular positions, as shown in FIG. 3, driving surfaces 236*a* and 237*a* engage the tabs 208 and 209, respectively. Rotation of the input shaft 244 in a clockwise direction by motor 20 and pulley 108 causes driving surfaces 236*a* and 237*a* to move about axis X—X. Their engagement with tabs 208 and 209, respectively, cause eccentric 206 of assembly E to orbit or move about axis X—X with an eccentricity equal to the offset of axis Y—Y from axis X—X (see FIG. 3).

Axis Z—Z of bore 212 in eccentric 206 is further offset from axis X—X of input shaft 244*c* by the offset between axis Y—Y and axis Z—Z. Output shaft 78 is received in bore 212 and thus is orbited or moved about axis X—X with an eccentricity equal to the total offset from axis X—X of input shaft 244*c* from axis Z—Z of output shaft 78. Since brake assembly D is effectively engaged by the downward force component acting on it, output shaft 78 is restrained from rotating about its axis Z—Z as it orbits or moves about the axis X—X of input shaft 244*c*. Thus, the output shaft 78 carries basket 32 so that the center or central axis of basket 32 orbits about the axis X—X of input shaft 244*c* with an eccentricity equal to the total offset between the axes X—X and Z—Z.

As can be seen in FIG. 3, the offset between axes X—X and Y—Y is equal to the offset between axes YY and Z—Z. In the exemplification each offset is 3/16 of an inch, the distance from X—X to Z—Z is $\frac{3}{8}$ of an inch and thus the eccentricity of the basket relative to the input shaft is $\frac{3}{8}$ of an inch so the total excursion of the basket is $\frac{3}{4}$ of an inch. This means the central axis of basket 32 moves such that it describes a cylinder as having its axis X—X, i.e., the axis of input shaft 244*c*, and a radius of $\frac{3}{8}$ of an inch relative to input shaft 244*c*. If transmission 74 and therefore input shaft 244*c* were absolutely fixed from any lateral or vertical movement, each point of the basket 32 would be driven by input shaft 244*c* to move in a circle having a diameter of $\frac{3}{4}$ of an inch. However, slight movement of the transmission is permitted by the suspension system as noted above, and the actual orbital excursion of each point of the basket 32 as measured from ground or a fixed reference point in space, is somewhat different than $\frac{3}{4}$ of an inch depending on the size of the load, speed of orbit, etc. Nonetheless, the orbiting motion generated by the transmission produces the washing motion described above.

It will be understood that while the amount of eccentricity built into transmission 74 may be varied, the total excursion of the basket 32 should be substantially less than the diameter of the wash basket, i.e., less than 20 percent thereof.

At the end of the orbital movement of the wash or rinse cycle, motor 20 is reversed and begins to rotate input shaft 244*c* of assembly F in a counterclockwise direction thereby driving drive tube 240 and eccentric 232 of assembly F in the same direction. Drive tube 240 and eccentric 232 of assembly F rotate approximately 180° with the bore 241 of tube 244*c* rotating relative to bearing surfaces 210 and 220 of assembly E. This translates or shifts the axis Y—Y of sleeve 206 from one side of input shaft 244*c*, as seen in FIG. 3, to the other side of input axis X—X, as seen in FIG. 5. This translation brings axis Z—Z of output shaft 78 into alignment with the axis X—X of input shaft 244*c*. During this 180° of rotation cam surfaces 234 and 235 of eccentric 232 engage tabs 208 and 209 of sleeve 206 and lift sleeve 206. At the end of the aforementioned 180° of rotation, driving surfaces 234*a* and 235*a* of eccentric 232 are in engagement with tabs 208 and 209, respectively. Continued rotation of input shaft 244*c* in the counterclockwise direction causes the assemblies E and F to rotate together about axis X—X in the configuration shown in FIG. 5 with input shaft axis X—X aligned with output shaft axis Z—Z.

Lifting of sleeve 206 compresses the components of clutch assembly C together and lifts plate 170 of coupling B. This substantially removes the compressive force from brake D and the brake is effectively disengaged to allow coupling B and shaft 78 to rotate under the driving force supplied through the clutch assembly C. With this configuration, axis Z—Z of shaft 78 is concentric with axis X—X of input shaft 244*c* and is rotated through clutch assembly C to rotate basket 32 for centrifugal water extraction.

Figure 4:
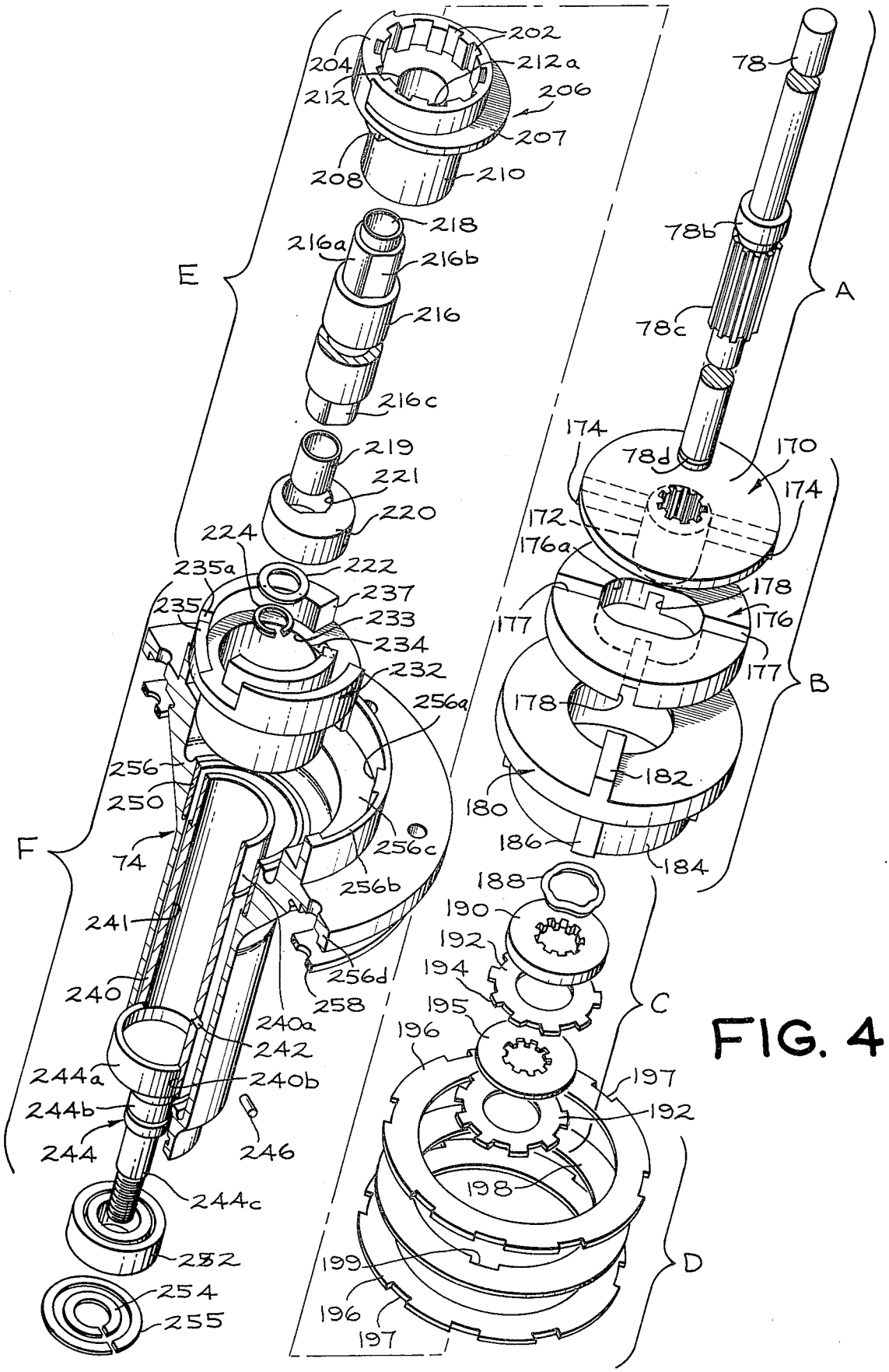
FIG. 4 is an exploded perspective view, partly in section, of the transmission of FIG. 3.

Referring to FIG. 4, it will be seen that the vertical translation of upper coupling plate 170 is accommodated by members 174 of plate 170 and slots 177 of center plate 176 without complete disengagement of members 174 from slots 177.

At the end of the centrifugal extraction (spin dry) cycle, the motor is de-energized. As the inertia of the motor 20 is much less than that of the basket 32, the basket becomes the effective driving force. This returns the transmission to its orbit configuration as shown in FIG. 3 and the brake quickly stops the basket.

Referring to FIG. 3, it will be seen that the complete transmission housing 256 is mounted to tub 36. An annular gasket 258 is fitted in a channel formed in an annular mounting collar 256*d* of housing 256 and bears against the tub with a liquid tight seal when the housing is bolted to tub 36 by a plurality of bolts 75 and retaining nuts 77. Clamp 84 secures a boot 82 to the cylindrical extension 256*b* of housing 256 with a liquid tight seal. The upper extremity of boot 82 is secured to a shaft seal assembly 82 by a clamp 88.

Shaft seal assembly 86 consists of a bearing 260 press-fitted to shaft 78, an annular bearing support sleeve 262 circumferentially enveloping bearing 260, a cup-like seal liner 264 and an annular seal 266, the liner 264 and seal 266 are press-fitted to sleeve 262. The seal assembly 86 is retained from axial translation along shaft 78 by thrust washer 268 secured to a circumferential groove 78*a* of shaft 78.

As described above, basket 32 and pan 140 are secured to the basket mounting hub 45 by a plurality of bolts 42, hub 45 being secured to vertical shaft 78 by the bolt 80 and a locking nut 81.

Alternate Clutch

Figure 7A:
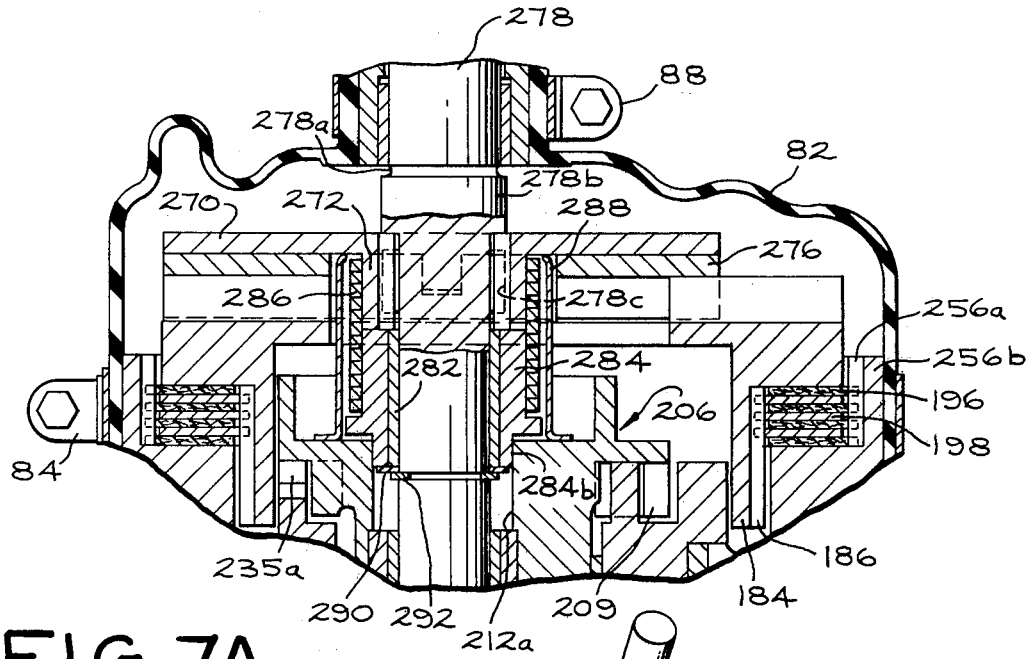
FIG. 7A is a fragmentary cross-sectional view of another form of a clutch mechanism which can be used in the illustrative transmission.
Figure 7B:
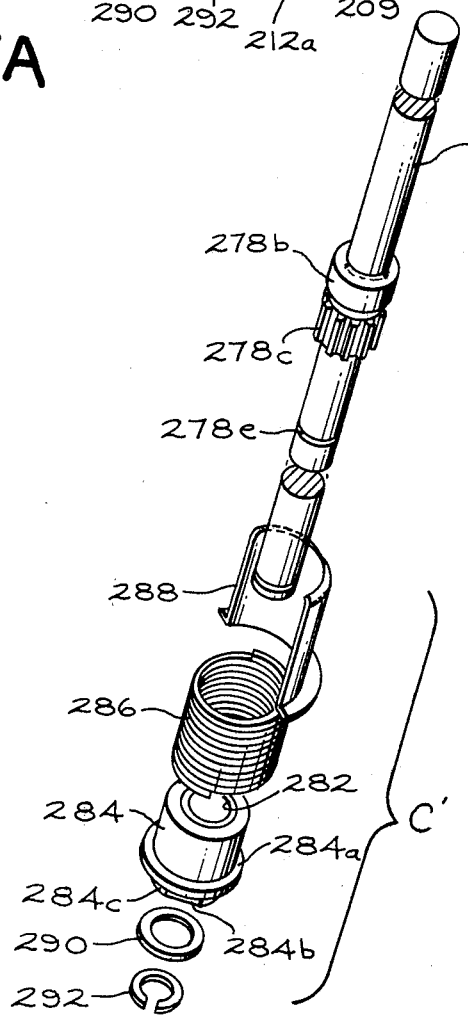
FIG. 7B is a fragmentary exploded perspective view illustrating certain details of the clutch mechanism of FIG. 7A.

Referring to FIGS. 7A and 7B, another form of a clutch is shown which may be used in place of that designated as clutch C in FIG. 4. FIG 7B shows the clutch mechanism C′ in an exploded perspective, and FIG. 7A shows the clutch mechanism assembled to the shaft and coupling assembly in the same relative position as that illustrated for clutch C in FIG. 3. The identical parts of the transmission are identified by the same reference numerals used in describing the mechanism of FIGS. 3 through 6. The shaft 278 is similar to shaft 78 except splined section 278*c* has been shortened. Upper coupling plate 270 corresponds to plate 170 except that the axial dimension of extenson 272 of upper coupling plate 270 has been shortened. The radial dimension of eliptical opening 276*a* of center plate 276 has also been slightly increased to receive this clutch assembly.

A sleeve bearing 282 is inserted into bearing housing 284, and a one-way clutch spring 286 and a grease retainer 288 are placed over the bearing housing 284 in engagement with an annular shoulder 284*a* formed thereon. This subassembly is then slid upwardly on shaft 278 until the upper axial surface of bearing 282 engages the axially lower radially extending portion of spline section 278*c* of shaft 278. Thrust washer 290 and snap ring 292 fix the clutch from axial translation by placement of snap ring 292 into an annular groove 278*e* in shaft 278. When shaft 278 is inserted in upper coupling plate 270, the spring clutch closely overlies extension 272. When the inner eccentric subassembly E is assembled to clutch subassembly C', a flat section 284*b* on a lower axial extension 284*c* of housing 284 engages flat section 212*a* of inner upper eccentric sleeve 206 for fixed common rotation therewith.

Spring 286 is commonly referred to in the art as an L.G.S. spring and is operative to slip when a member to which it is mounted moves rotationally in one direction but lockably engages the member to which it is mounted when it rotates in the reverse direction. When inner and outer eccentric assemblies E and F, and therefore bearing housing 284, are driven in the clockwise or orbiting direction, bearing housing 284 rotates within spring 286 in a slipping mode of operation. However, counterclockwise rotation of the inner and outer eccentric assemblies, and therefore housing 284, causes spring 286 to lockably engage housing 284 to the axial extension 272 of upper coupling plate 270. The relative axial alignment of shaft 278 in the orbiting mode and in the spin mode, and the operation of the brake assembly D, are the same as was described in reference to FIGS. 3–6. That is, counterclockwise rotation of the input shaft 244*c* causes sleeve 206 to rise vertically as tabs 208 and 209 ride up cams 234 and 235 thereby releasing the compressive braking forces exerted against brake assembly D through coupling B. Since plate 270 is splined to shaft 278, the counterclockwise rotational movement of the rotary drive elements is transmitted to shaft 278 causing it to also rotate about its own axis.

Alternate Transmission

Figure 9:
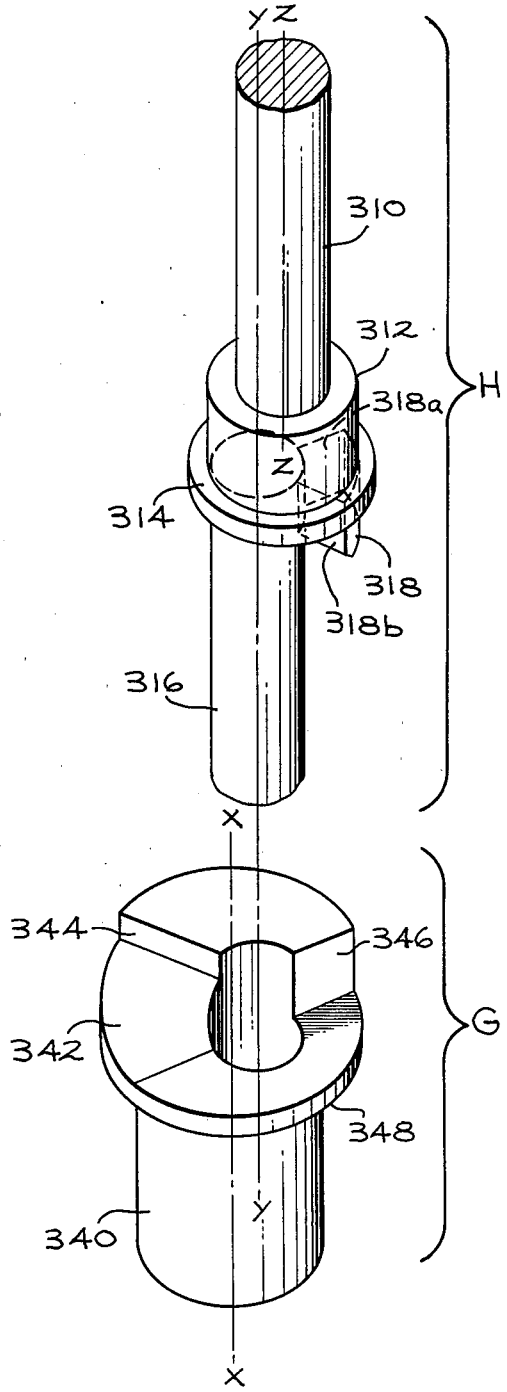
FIG. 9 is an exploded perspective view of parts of the transmission shown in FIG. 8.
Figure 8:
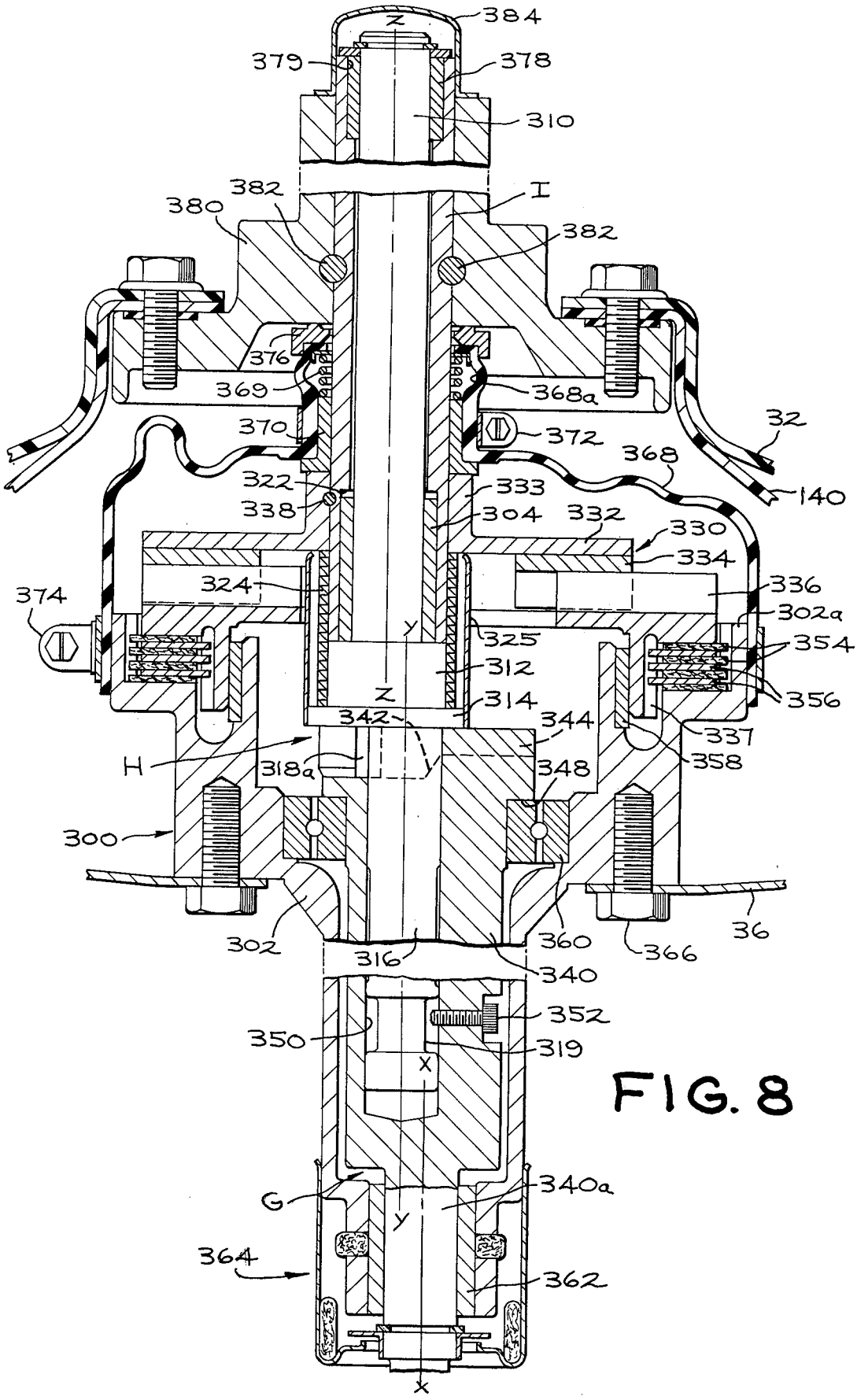
FIG. 8 is a cross-sectional view of another form of transmission which can be used in the washing machine of FIG. 1.

Referring to FIGS. 8 and 9, another form of transmission for use in the present invention is shown. Transmission 300 has three primary rotary drive elements: an input shaft G, an eccentric or crankshaft H and the output or straight drive tube I. The three rotary drive elements are mounted for selective rotational movement relative to each other in transmission housing 302.

The operation of transmission 300 is very similar to that of transmission 74 of FIGS. 3–6. The input drive or assembly F of transmission 74 performs the same function as input shaft G of transmission 300; that is, to deliver input torque in order to drive the output shafts A and I, respectively, in two different modes of operation, i.e., an orbiting washing mode and a spin extraction mode. For the orbital mode, both transmissions shift the axes of the output shafts slightly from the principal axis, i.e., the axis of the input shafts, whereas for the spin mode, the transmissions align the axes of the input and output shafts. The shifting or switching between the two modes is accomplished through a lost-motion connection between the inner and outer eccentric assemblies E and F of transmission 74 and lost-motion between input assembly G and crankshaft H of transmission 300. In both transmissions, the output shafts are connected to drive the basket in an orbital mode for wash and rinse and in a rotary mode for spin. The relative spacing of the input and output axes X—X and Z—Z, as well as the placement of the axis Y—Y of the intermediate elements E and H, is identical. Thus, the eccentricities of transmission 300 either add as in orbit to provide a basket excursion of $\frac{3}{4}$ of an inch, or cancel as in spin whereby axes X—X and Z—Z are aligned. The manner in which transmission 300 accomplishes these operations will now be described.

In the order of assembly, sleeve bearing 304 is slid on the upper shaft or offset portion 310 of the crankshaft assembly H and into engagement with an annular axially extending collar 312. Output or drive tube I, having an annular channel 322 formed on its lower radially inner surface, is slid over bearing 304 until it also engages collar 312 with channel 322 fitting around sleeve bearing 304. L.G.S. spring 324, similar to that shown as clutch C' in FIGS. 7A and 7B, and grease-retaining cap 325 are slid downwardly over drive tube I into engagement with annular flange 314 of the crankshaft H. The inner diameter of spring 324 is sized to contactively engage the circumferential surfaces of collar 312 and tube I.

The Oldham coupling assembly 330 consisting of upper, center and lower plates 332, 334 and 336, respectively, are slid onto drive tube I and into engagement with spring 324 and cup 325. Oldham coupling 330 is similar to that shown as coupling B in FIG. 4; however, the upper plate 332 has an axially upward extension 333 which is rotationally fixed to spin tube I such as by use of a pin 338 inserted through a bore drilled through extension 333 and a complementary notch drilled tangentially through drive tube I.

Crankshaft H also includes a lower axially extending shaft 316, and a slide or cam follower 318 (see FIG. 9) protrudes axially downwardly from flange 314. The upper shaft 310 is formed along an axis Z—Z and the lower shaft is formed along an axis Y—Y, with the two axes being offset one from the other as in the prior embodiment.

The input or eccentric drive tube G consists of a central portion 340 having a cam surface 342 and two driving surfaces 344 and 346 formed on and extending axially from its upper radial surface. (This is more clearly seen in FIG. 9 in which the rotary drive elements G and H are shown rotated 180° from FIG. 8.) Drive tube central portion 340 also includes an annular bearing engaging shoulder 348 and a reduced diameter lower extension 340*a* to which is connected the drive pulley 108 (not shown). The main axis of drive tube G, including the lower extension 340*a* is X—X. An axially extending bore 350 is drilled in central portion 340 along axis Y—Y, which is offset from axis X—X as in the prior embodiment.

Elements H and I are assembled to element G by inserting shaft 316 into bore 350 of rotary drive element G. The assembly is provided with limited axial displacement by inserting a bolt 352 through an aperture of the central section 340 of the eccentric drive tube G so that the lead end of the bolt protrudes into an annular channel 319 formed on the outer circumference of lower shaft 316. The brake liner members 354 are assembled to the splined extension 302*a* of housing 302, and brake discs 356 are assembled to the splined flange 337 of lower coupling plate 336, in a manner as was described above in reference to the brake assembly D of FIG. 4, and the complete assembly is placed into housing 302. The splined flange 337 of lower coupling plate 336 engages a sleeve bearing 358, annular shoulder 348 of shaft 340 engages a ball bearing assembly 360, and the reduced axial extension 340*a* of tube 340 engages a sleeve bearing 362. A bearing lubrication assembly 364, commonly known in the art, may be fitted to the shaft extension 340*a* and exterior housing 302 as shown.

A boot assembly consisting of a flexible boot 368 and a sleeve bearing 370 to which the upper end of the boot is secured by means of a clamp 372 is assembled to the output drive tube I. The lower portion of boot 368 is clamped to housing 302 by means of a clamp 374. A compression spring 369 is encapsulated within upper extension 368*a* of boot 368 and engages the upper extremity of bearing 370 and the radially extending surface of extension 368*a*. The spring 369 forces boot extention 368*a* against a face seal 376.

Bearing 378 is placed in an appropriate groove 379 formed in the inner surface of drive tube I and engages shaft 310, and the basket hub 380 is mounted to drive tube I by pins 382, thereby locking the basket hub to the drive tube 320. Retaining cap 384 is fitted to the axially upper extremity of basket hub 380.

The complete transmission assembly is bolted to the tub 36 by a plurality of bolts 366.

Upon clockwise rotation of input shaft or rotary drive member G, driving surface 346 engages face 318*a* of cam follower 318 and drives shaft H, and therefore basket 32, in an orbital path about the input axis X—X while basket 32 is held from rotation about its own axis Z—Z by the brake assembly. The excursion of the orbital path is the offset of axis Y—Y from axis X—X plus the offset of axis Z—Z from axis Y—Y.

Upon counterclockwise rotation of rotary drive element G, the cam surface 342 of eccentric drive tube 340 engages the face 318*b* of cam follower 318, axially lifting rotary drive assembly H, relieving the braking forces applied to the brake assembly through lower coupling plate 336. It will be understood that the relative angular motion permitted between input shaft G and crankshaft H is 180° so that the axis Z—Z of the output shaft I is shifted into concentric alignment with axis X—X of member G. Counterclockwise rotation of rotary drive element G causes spring 324 to lockably engage annular collar 312 of drive element H and output tube I, causing output tube I, and therefore the basket 32, to be rotated about axis Z—Z in a counterclockwise direction for centrifugal liquid extraction.

At the end of the centrifugal extraction (spin dry) cycle, the motor is de-energized. As explained above regarding transmission 74, this returns the transmission to its orbit configuration, as shown in FIG. 8, and the brake quickly stops the basket.

Alternate Coupling

Figure 10A:
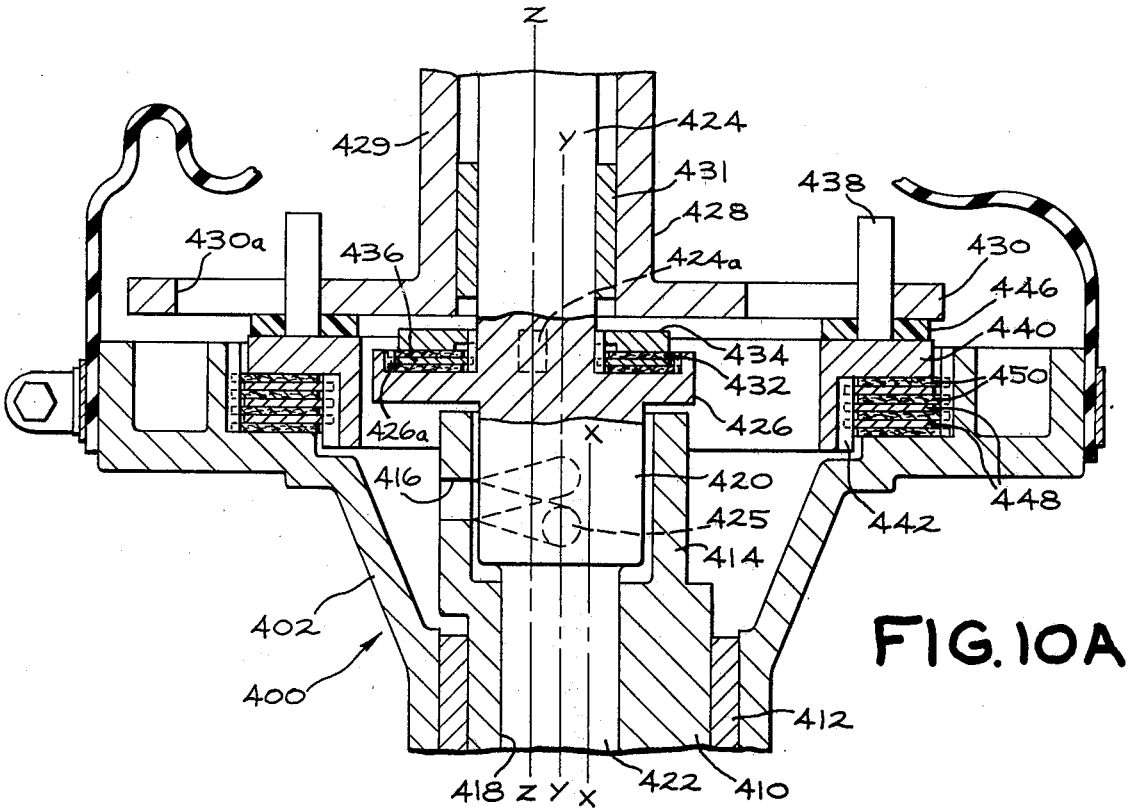
FIG. 10A is a fragmentary cross-sectional view of another coupling mechanism which may be utilized in the transmission of one form of the invention.
Figure 10B:
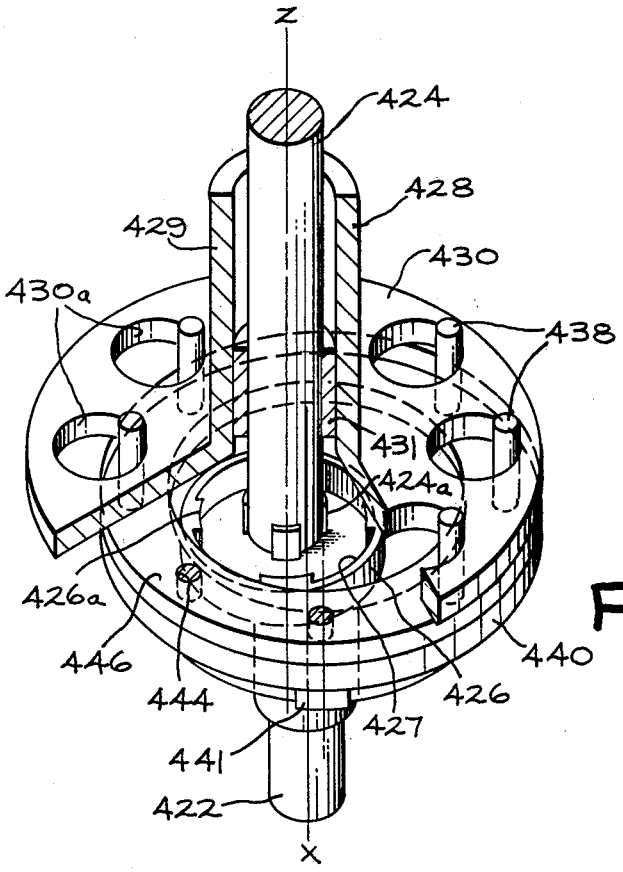
FIG. 10B is a fragmentary exploded perspective view illustrating certain details of the coupling mechanism of FIG. 10A.

Referring to FIGS. 10A and 10B, there is shown still another form of eccentric coupling which may be used with the present invention. The transmission 400 includes a housing 402, which may be mounted to a washer tub (not shown). An eccentric rotary drive input tube 410 is mounted within housing 402 by sleeve bearing 412 and is suitably connected for being driven by pulley 108 shown in FIG. 1. The lower portion of transmission 400 may be of the construction of transmission 300 shown in FIG. 8. Drive tube 410 includes an axially extending yoke 414 having a cam groove in the form of a helix 416 formed therein. A cylindrical bore 418 is drilled in member 410 for receipt of an offset or crankshaft 420 similar to the rotary drive element H of FIG. 8. Crankshaft 420 has a lower axial extension 422 mounted within bore 418 of drive tube 410 and an offset or eccentric upper shaft 424 which extends vertically from an annular flange 426. A basket hub or rotary output member 428 is concentrically mounted to shaft 424 by means of a sleeve bearing 431. Input drive 410 has an axis of rotation X—X, lower shaft 422 of the crank member 420 has an axis Y—Y eccentric to axis X—X, and shaft 424 has an axis Z—Z eccentric to axis Y—Y. Crankshaft 420 has a radially extending pin 425 (shown in phantom, FIG. 10A) received in slot 416 of drive tube 410.

The relative eccentricities and spacing of axes X—X, Y—Y and Z—Z are the same as set forth above for transmissions 74 and 300, and the operation of offsetting and aligning axis Z—Z relative to axis X—X for orbit and spin, respectively, is also similar to that of transmission 74 and 300.

A clutch assembly such as subassembly C of transmission 74, shown in FIG. 4, is received in an annular slot 427 formed in flange 426 of crankshaft 420. The clutch liners 432 and thrust washer 434 are mounted on splined section 424*a* of shaft 424 while clutch discs 436 are mounted to splines 426*a* of flange 426.

Basket hub 428 has a cylindrical axially extending section 429 which is suitably connected to the basket and boot seal structure (not shown) which, for example, may be of the construction used in the transmission 300 of FIG. 8. Basket hub 428 also has an annular flange 430 having a plurality of equally spaced apertures 430*a* formed therethrough. The diameter of the apertures 430*a* is equal to twice the eccentricity (total offset between axes X—X and Z—Z, plus the diameter of the pins 438 which protrude vertically upward from lower coupling plate 440. Pins 438 are mounted to or formed on lower coupling plate 440 and protrude through apertures 444 in a disc 446 which is fabricated from a low friction material to permit basket hub 428 to freely slide on disc 446. As was generally described above in regard to the other illustrative transmission assemblies, with a selected eccentricity of 3/16 of an inch between each pair of axes, the total excursion of the basket hub 428, and therefore the basket itself, will equal $\frac{3}{4}$ of an inch which is equal to twice the distance between the axes X—X and Z—Z. In this example, the diameter of apertures 430*a* will equal $\frac{3}{4}$ of an inch plus the diameter of pins 438.

In operation, input drive tube 410 is driven in a clockwise direction during the washing and/or rinsing operations driving the crankshaft 420 in a clockwise direction thereby causing the basket hub 428 to move in orbital path about the axis X—X. Basket hub 438 is restrained from rotating about its own axis Z—Z due to the weight of the basket being applied to the brake assembly through hub 428 which holds lower coupling plate 440 from rotation.

When the eccentric drive tube 410 is rotated in a counterclockwise direction, crankshaft 420 translates in an axial direction as pin 425 thereof rides upwardly along the slot or groove 416 of drive tube 410, relieving the braking forces applied through plate 440. The relative angular movement of the drive tube 410 relative to the crankshaft 420 is limited to 180° as shown by the slot 416 thereby cancelling the eccentricities and shifting axis Z—Z into alignment with axis X—X. Thus, upper shaft 424 aligns with the input axis X—X and the basket hub 428 is concentric with axis X—X. The vertical displacement of crankshaft 420 causes the clutch assembly through thrust washer 434 to engage the basket hub 428 and the basket hub 428 is driven in a counterclockwise direction for water extraction. At the conclusion of spin, the weight of the basket causes crankshaft 420 to again rotate relative to input drive 410 so the transmission assumes the position shown in FIG. 10A and the brake is applied, stopping the basket from rotating.

Control Circuitry

Figure 11:
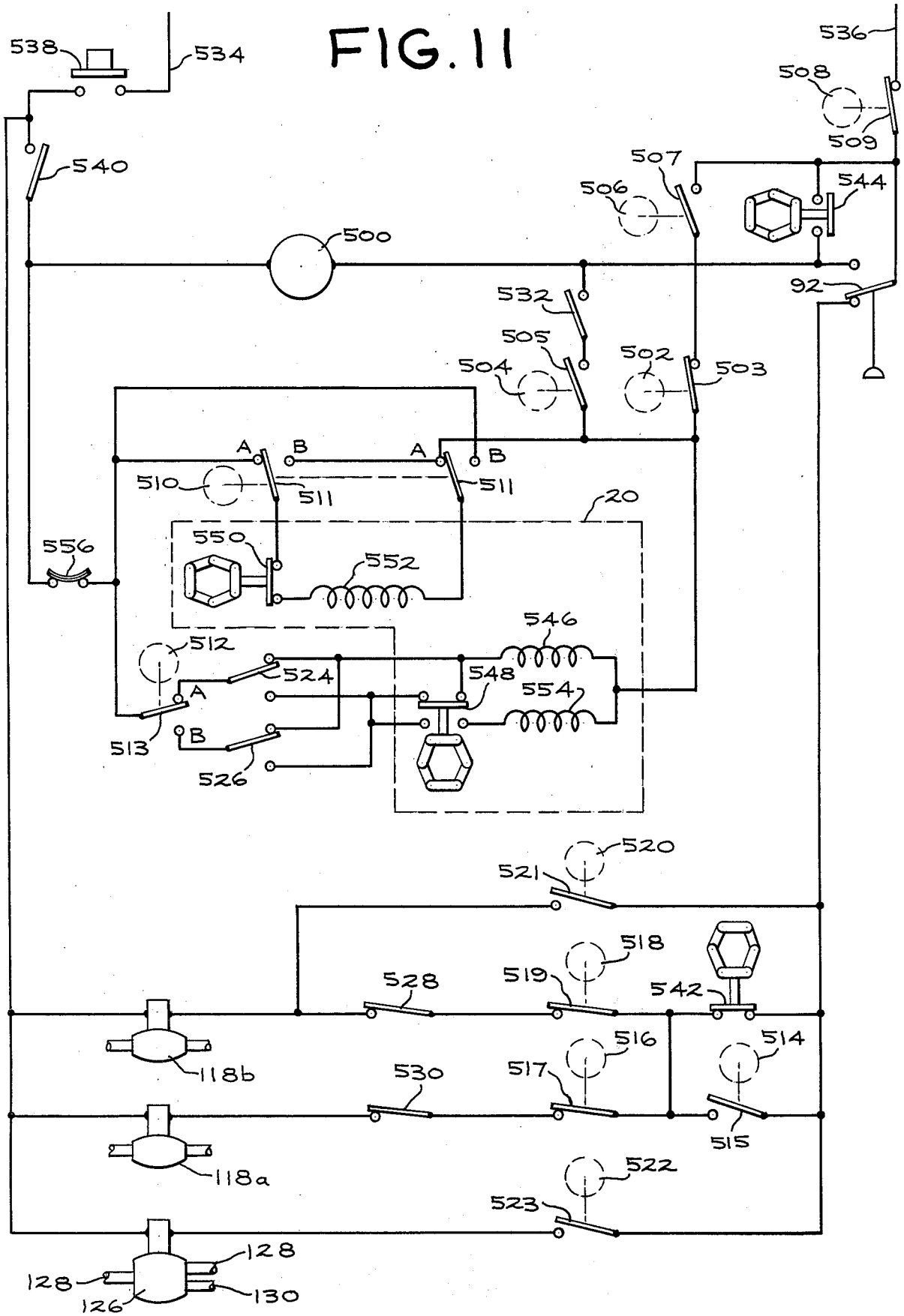
FIG. 11 is a circuit schematic diagram of an electromechanical control circuit showing one embodiment of the sequence control mechanism for the machine of FIG. 1.

Referring to FIG. 11, the electrical control system for washing machine 10 of FIG. 1 will be described. In connection with the circuit of FIG. 11, it will be understood that present-day washers often include various improvements such as control panel lights, etc., which do not relate to the present invention, and to some extent these have been omitted for the sake of simplicity and ease of understanding.

Figure 12:
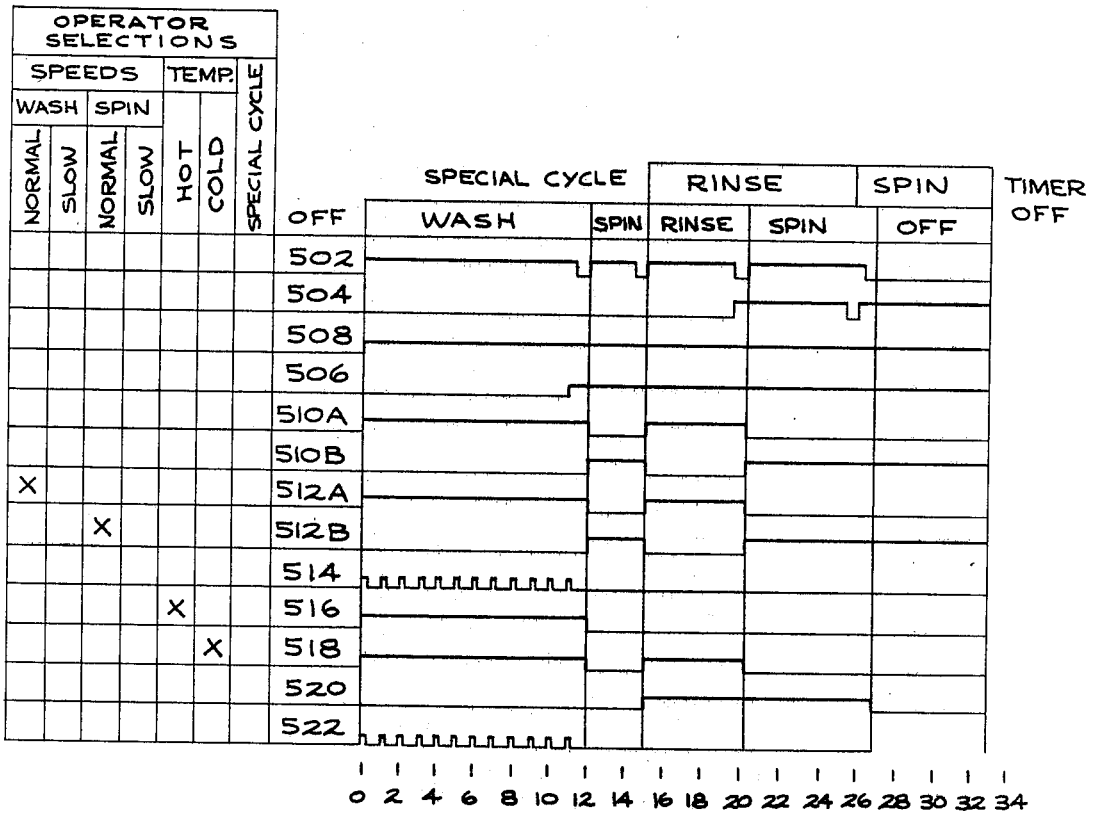
FIG. 12 is a timer cam chart illustrating the control of the timer operated switches of FIG. 11 to provide a typical wash/dry cycle of the machine of FIG. 1.

In order to control the sequence of operation of components of machine 10 of FIG. 1, the circuit includes an automatic sequence control assembly which incorporates a timer motor 500 driving a plurality of cams 502, 504, 506, 508, 510, 512, 514, 516, 518, 520 and 522. These cams, during their rotation by the timer motor 500, actuate various switches (as will be described) causing the machine to pass through an appropriate cycle of operations, first wetting the clothes, then washing the clothes, centrifuging the wash water from the clothes, then rinsing the clothes and finally centrifuging the rinse water from the clothes. The operating surfaces of the various cams are indicated in the schematic view of FIG. 12.

A typical cycle may, for example, be selected when the user has a seven-pound load of fabric articles of both cotton and synthentic material, the clothing having a normal soil level. The cycle may utilize a warm wash and a cold rinse with a normal speed wash, rinse and spin and a wash time of approximately nine minutes. User selections are implemented on control panel 18 in any of many different forms known in the art such as pushbutton switches, toggle switches, rotary switches and slide switches. The user selector switches are shown schematically in FIG. 11 as switches 524, 526, 528, 530 and 532. Each selection made for the illustrative operation of the typical cycle is shown by an X in the left hand portion of the timer chart of FIG. 12. Switches 524 and 526 are in the upper position to provide normal speed for wash and spin, switches 528 and 530 are closed to allow opening of the hot and cold water valves **118*a* and 118*b*, respectively, by cam-operated switches 517 and 519, and switch 532 is opened to prevent operation of the special optional cycle which (in conjunction with cam switch 521**) would provide an extended rinse operation. The remaining user selection involves the wash time, which for the illustrative cycle requires turning a timer knob (not shown) so that the cycle starts at the three-minute point of Chart 12. This leaves the desired nine minutes of wash time left on the timer cams.

The electric circuit as a whole is energized from a power supply, such as the normal household supply, through a pair of conductors 534 and 536. The circuit includes a manually operated push-pull switch 538 which is closed by the operator for initiating the cycle, and a lid switch 540 which is closed when the lid is closed. At the beginning of the cycle the water level pressure switch 92 is in its "down" position as shown so when the operator actuates switch 538, assuming the washer has been loaded and the lid is closed, water valves **118*a* and 118*b* are energized since water selection switches 528 and 530 are closed and cam-actuated switches 517 and 519 are closed by cams 516 and 518, respectively, and motor-operated, normally-closed centrifugal switch 542 is also in its closed or "down" position. Motor 20 and timer motor 500 are inoperative due to cam bypass switch 507 being held open by cam 506 and motor-actuated centrifugal switch 544 begins in its normally open position as seen. Cam-actuated switches 503 and 509 are closed by cams 502 and 508, respectively, enabling subsequent motor operation. Cam-actuated switch 523 is opened by cam 522 so that the output of the mixing valve assembly 118 is directed to only the fill ring 132 by the diverter assembly 126**.

Initially, water enters basket 32 from ring 132 to wet the fabrics. When the fabrics are wet, water will flow out of the basket and collect in sump 90. When sufficient water has collected in the washer sump 90, water level pressure switch 92 is activated thereby moving to the "up" position. This momentarily connects the power supply to the timer motor 500 and the drive motor 20. Motor 20 starts in the "normal" speed through run winding 546 regardless of the speed selected by the operator due to the normally "up" position of motor speed centrifugal switch 548. As motor 20 comes up to speed, normally closed centrifugal switch 550 is opened to de-energize start winding 552; switch 548 moves to the "down" position for possible connection of the motor to the slow speed winding 554; however, the normal winding remains in the circuit because of the settings of switches 524 and 526; centrifugal switch 542 opens permitting the water flow to be determined by cam 514 and switch 515; and normally open centrifugal switch 544 closes. At this stage of operation, motor 20 and timer 500 are connected such that they will continue to run until the main switch 509 opens under the influence of cam 508, even though the washer pump 98 has drained the sump 90 thereby resetting the pressure switch 92 to the "down" position.

The machine now proceeds through nine minutes of orbital washing action. Switches 515 and 523 are closed for fifteen seconds once each minute so that water is periodically provided to the machine with the flow divided between the ring 132 and trough 26. Pump 98 drains the water as it accumulates in sump 90. Just before the end of wash, cam 506 closes switch 507. This continues operation of timer motor 500 and enables restart of drive motor 20 even though centrifugal switch 544 opens when motor 20 pauses at the end of wash.

At the end of the wash portion of the cycle, cam switch 503 is opened, initiating a short pause. Cam 510 moves switch 511 to position "B" so that the polarity of start coil 552 is reversed for reverse rotation of the motor. Switch 503 is reclosed and spin begins. At the end of the spin cycle, switch 503 again opens, switch 511 moves to position "A" connecting the start winding for the "orbit" rotation of motor 20 and switch 503 is reclosed. A rinse operation follows in a very similar manner to the wash operation.

Note that during the rinse portion of the cycle, switch 521 is closed by cam 520 and switch 515 is opened by cam 514 so that only cold water is allowed to flow into the basket, and that switch 523 is open so all the water enters the basket through ring 132. At the end of rinse, the motor is once again reversed and a final spin is accomplished, after which the machine turns off.

With the above-described control circuitry, one will appreciate that the amount of wet down will satisfy the particular load demand as water will not begin to accumulate in sump 90 until the fabric articles are sufficiently wet. Also, a variable wash time has been provided since the timer may be set anywhere in the wash phase of the cycle. To select the special cycle the operator may close the switch 532, causing a similar closing of switch 505 by cam 504 which extends the rinse cycle by bypassing the open switch 503 which opens at the conclusion of the typical cycle's final rinse. This special cycle permits an extended rinse with maximum water flow-through for good heavy soil removal. Also, with the positioning of the water level pressure switch 92 as shown, one skilled in the art will appreciate that a water level override feature is inherently provided. That is, the circuit controlling the water valves will be open, terminating water flow whenever the water level in sump 90 is sufficient to move switch 92 to the "up" position. A thermal overload switch 556 has also been provided to prevent motor 20 from being overheated, as is normal in the art.

If desired, a further operating step may be added to the washing machine operation following the final spin step of the normal washing cycle. This additional step comprises a fluffing operation during which the spin dried clothes are moved within the basket without the addition of water. This movement separates the individual clothing articles from each other and from the basket sidewall thereby allowing the clothes to be removed in a somewhat fluffed condition. In this additional step, the basket is moved by transmission in its orbital mode of operation, but without any water being introduced into the basket. The basket side wall striking the clothes in the same manner as in wash or rinse causes the separation and fluffing of the clothes. A modification of the control circuit can appropriately be made to accomplish this additional step.

I claim:

1. A washing machine for fabric articles comprising: a receptacle having a central axis and arranged to receive washing liquid and a fabric article load to be washed by the liquid; means for supplying washing liquid to said receptacle and means for draining liquid from said receptacle, said liquid supply means and said drain means together constituting means effective to maintain the fabric article load in a liquid-soaked condition while accumulating no more liquid in said receptacle than would immerse the lower portion of a full load of fabric articles; drive means connected to said receptacle, said drive means including means to selectively laterally offset the receptacle axis with respect to a predetermined axis so that said receptacle axis moves in direct response to said drive means in a predetermined path about said predetermined axis, said drive means including means for restraining said receptacle from rotating about the receptacle axis during movement of the receptacle axis in the predetermined path; thereby to cause interaction between the wall of said receptacle and the fabric articles for washing the fabric articles.

2. The washing machine of claim 1 wherein the receptacle axis is arranged to move in an orbital path parallel to the predetermined axis.

3. The washing machine of claim 2 wherein the diameter of the orbital path of said receptacle is less than about twenty percent of the width of said receptacle.

4. The washing machine of claim 1 wherein said drive means further includes means for rotating said receptacle for centrifugal extraction of liquid from the article load.

5. The washing machine of claim 4 wherein said drive means further includes means to move the receptacle axis into substantially coaxial alignment with the predetermined axis for rotation of the receptacle.

6. The washing machine of claim 1 further including means on the wall of said receptacle for repeatedly contacting the fabric load during the movement of said receptacle thereby to induce toroidal movement of the fabric article load.

7. The washing machine of claim 1 or 6 wherein said means for supplying washing liquid to said receptacle includes spray means operative initially to wet the fabric article load and then to spray the fabric article load during washing to maintain the fabric article load in a wet condition; and wherein said means for draining liquid from said receptacle is effective for continuously draining washing liquid from said receptacle.

8. The washing machine of claim 7 wherein said spray means is operative for supplying washing liquid to said receptacle as a series of interrupted liquid pulses.

9. The washing machine of claim 7 further including means for creating a relatively shallow pool of washing liquid in which the bottom portion only of said receptacle is immersed and means for continuously draining liquid from the bottom portion of said pool as liquid flows into the top portion of the pool, thereby to enhance removal of particulate soil from the fabric article load.

10. The washing machine of claim 6 wherein said means on the wall of said receptacle comprises a plurality of generally vertically extending ribs formed on at least the lower portion of the inner surface of said wall for increasing the annular movement of the fabric article load caused by contacts of said wall.

11. The washing machine of claim 6 or claim 10 wherein the means to induce toroidal movement comprises a plurality of inclined vanes formed on the inner surface of said wall of said receptacle, said vanes extending upwardly along the lower portion of said receptacle wall and being inclined in the direction of annular fabric article movement, for causing the fabric articles to turn over during washing.

12. The washing machine of claim 6 wherein said receptacle includes a central post having a flared skirt at the bottom thereof, said skirt having vanes formed thereon, said vanes extending spirally outwardly and sloping downwardly in the direction of annular movement of the fabric articles.

13. A method of washing a fabric article load in a receptacle adapted to receive the article load and washing liquid, comprising the steps of: moving the axis of the receptacle into laterally offset relationship with respect to a predetermined axis, moving the receptacle axis about the predetermined axis while restraining the receptacle from rotating about the receptacle axis to induce repeated contacts between the wall of the receptacle and the fabric article load to wash the load, returning the receptacle axis from its laterally offset relationship with respect to the predetermined axis, and revolving the receptacle to extract liquid centrifugally from the article load.

14. The method of claim 13 wherein the receptacle axis is returned into substantially coaxial alignment with the predetermined axis for centrifugal extraction of liquid from the article load.

15. A washing machine including: an open-topped, perforate, receptacle having a central axis and mounted in an upright position to receive washing liquid and a load of fabric articles to be washed by the liquid; means for supplying washing liquid to said receptacle and means for draining liquid from said receptacle, said liquid supply means and said drain means together constituting means effective to maintain the fabric article load in a liquid-soaked condition while accumulating no more liquid in said receptacle than would immerse the lower portion of a full load of fabric articles; input drive means rotatable about its axis; means connecting said receptacle to said input drive means to selectively laterally offset the central axis of said receptacle from the axis of said input drive means so that said receptacle moves about the axis of the input drive means in response to rotation of said input drive means; means for restraining said receptacle from rotation about its central axis as said receptacle moves about the axis of said input drive means; whereby movement of the receptacle induces repeated contacts between the wall of the receptacle and the fabric articles to wash them; and means connected to the receptacle for rotating said receptacle to centrifugally extract washing liquid from said articles.

16. A washing machine for fabric articles comprising: an open-topped perforate receptacle arranged to receive washing liquid and a fabric article load to be washed by the liquid; means for supplying washing liquid to said receptacle and means for draining liquid from said receptacle, said liquid supply means and said drain means together constituting means effective to maintain the fabric article load in a liquid-soaked condition while accumulating no more liquid in said receptacle than would immerse the lower portion of a full load of fabric articles; a mount drivingly connected to said receptacle; drive means connected to said receptacle mount to selectively laterally offset said receptacle mount from a predetermined axis and move said receptacle mount in a predetermined path about and laterally spaced from the predetermined axis and to selectively rotate said receptacle mount; means for restraining said receptacle from rotation as said receptacle moves in the predetermined path so that movement of said receptacle causes interaction between the wall of the receptacle and the fabric articles for washing the fabric articles; said restraining means releasing said receptacle for rotation with said receptacle mount for centrifugal extraction of liquid from the fabric article load.

17. The washing machine of claim 16 further including means on the wall of said receptacle for repeatedly contacting the fabric load as said receptacle moves about the axis of said drive means thereby to induce toroidal movement of the fabric article load.

18. The washing machine of claim 17 wherein said means for supplying washing liquid to said receptacle includes spray means operative initially to wet the fabric article load and then to spray the fabric article load during washing to maintain the fabric article load in a wet condition; and wherein said means for draining liquid from said receptacle is effective for continuously draining washing liquid from said receptacle.

19. The washing machine of claim 18 wherein said spray means is operative for supplying washing liquid to said receptacle as a series of interrupted liquid pulses.

20. The washing machine of claim 18 further including means for creating a relatively shallow pool of washing liquid encompassing the bottom portion of said receptacle for enhancing removal of particulate soil from the fabric article load.

21. The washing machine of claim 15 wherein said means connecting said receptacle to said input drive means is constructed and arranged after the centrifugal extraction to again laterally offset the axis of said receptacle from the axis of said input drive means so that said receptacle moves about the axis of said input drive means in response to rotation of said input drive means and in the absence of additional washing liquid for loosening the fabric article load.

22. The washing machine of claim 15 wherein the length of the lateral offset of the axis of said receptacle axis from the axis of the input drive means is less than about twenty percent of the radius of said receptacle.

23. A washing machine including: an open-topped, perforate, generally cylindrical receptacle mounted in an upright position to receive washing liquid and a fabric article load to be washed by the liquid; means for supplying washing liquid to said receptacle; drive means connected to said receptacle and effective for moving said receptacle with its central axis following an orbital path about a second axis substantially parallel to and spaced a predetermined distance from the central axis of said receptacle, the radius of said receptacle being substantially greater than the predetermined distance; said drive means maintaining said receptacle in a predetermined attitude relative to the second axis during the orbital movement for effecting washing of the fabric load, and said drive means including means for translating said receptacle to bring the receptacle axis into alignment with the second axis and for rotating said receptacle about its axis to centrifugally extract washing liquid from the fabric article load and said receptacle.

24. The washing machine of claim 23 further including brake means operatively connected to said receptacle and effective to restrain said receptacle from rotating about its axis during orbital movement of said receptacle.

25. The washing machine of claim 23 wherein said drive means includes a reversible motor and transmission means; said transmission means being operatively connected between said motor and said receptacle, said transmission means being responsive to rotation of said motor in one direction to cause the orbital movement of said receptacle and responsive to rotation of said motor in the other direction to cause the axis of said receptacle to move into alingment with the vertical axis and therefore to cause said receptcle to rotate about the vertical axis.

26. The washing machine of claim 23 wherein: said drive means includes a transmission having a generally vertical principal axis of rotation; said receptacle is mounted on a rotary drive member; and said transmission is effective to offset the axis of said rotary drive member the predetermined distance from the principal axis of rotation of said transmission for orbital movement of said receptacle and to align the axis of said rotary drive member with the principal axis of rotation of said transmission for centrifugal extraction rotation of said receptacle.

27. The washing machine of claim 23 further including means on the wall of said receptacle for repeatedly contacting the fabric load during the orbital motion of said receptacle thereby to induce an annular and toroidal movement of the fabric article load.

28. The washing machine of claim 27 wherein said means for supplying washing liquid to said receptacle includes spray means operative to initially wet the fabric article load and then to spray the fabric article load during washing to maintain the fabric article load in a wet condition; and wherein said washing machine further includes means for continuously draining washing liquid from said receptacle.

29. The washing machine of claim 28 further including means for creating a relatively shallow pool of washing liquid encompassing the bottom portion only of said receptacle for enhancing removal of particulate soil from the fabric article load.

30. The washing machine of claim 27 wherein said drive means is effective after the centrifugal extraction operation to again move said receptacle with its axis following the orbital path about the second axis in the absence of additional washing liquid for loosening the fabric article load.

31. A method of washing fabric articles comprising steps of: disposing the articles in an open-topped receptacle; introducing washing liquid into the receptacle; orbiting the receptacle about a second axis spaced a predetermined distance from the axis of the receptacle, with the radius of the receptacle being substantially larger than the predetermined distance, while restraining the receptacle from rotating about the receptacle axis for washing the fabric articles; moving the receptacle so that the receptacle axis is in alignment with the second axis; and rotating the receptacle about the second axis to centrifugally extract the wash liquid from the receptacle and the fabric articles.

32. The method of claim 31 including the further step of orbiting the receptacle about the second axis in the absence of additional washing liquid to loosen the fabric articles.

33. A drive arrangement for driving a washing machine fabric receiving basket comprising: a first rotary drive element having an axis of rotation; rotary drive means drivingly connected to said first rotary drive element for rotating said first rotary drive element about its axis of rotation; a second rotary drive element mounted eccentric to the axis of and driven by said first rotary drive element for movement about the axis of rotation of said first rotary drive element; a third rotary drive element mounted eccentric to the axis of and driven by said second rotary drive element for movement about the axis of rotation of said first rotary drive element; and means interconnecting said third rotary drive element with said basket so that said basket is moved with its axis following an orbital path as said third rotary drive element moves about the axis of rotation of said first rotary drive element.

34. The washing machine drive arrangement of claim 33 further including means allowing relative movement of said first and second rotary drive elements between first and second relative angular positions; the eccentric mounting of said second and third rotary drive elements being such that the axis of rotation of said third rotary drive element and the axis of rotation of said first rotary drive element are eccentrically located for orbital movement of said basket when said first and second rotary drive elements are in their first relative angular positions and are concentrically located for rotation of said basket about the axis of said third rotary drive element when said first and second rotary drive elements are in their second relative angular positions.

35. The washing machine drive arrangement of claim 34 further including: clutch means interconnecting said second rotary drive elements and said third rotary drive element for rotation of said third rotary drive element about its own axis of rotation when said first and second rotary drive elements are in their second relative angular positions.

36. The washing machine drive arrangement of claim 34 wherein said first and second rotary drive elements are arranged and constructed such that rotation of said first rotary drive element in a first direction is effective to cause said first and second rotary drive elements to assume their first relative angular positions and rotation of said first rotary drive element in a second direction is effective to cause said first and second rotary drive elements to assume their second relative angular positions.

37. The washing machine drive arrangement of claim 33 further including: a machine cabinet structure; a tub supported from said cabinet structure for movement relative to said cabinet structure; said basket being positioned in said tub; means for supporting said first rotary drive element from said tub; and means for coupling said basket to said tub, said coupling means being operative to restrain said basket from rotating about its own axis when orbited by said third rotary drive element.

38. A washing machine comprising: a washing machine cabinet structure; a tub suspendedly mounted to said cabinet structure for movement relative thereto; a perforate basket supported within said tub for receiving fabric articles and washing liquid; means for supplying washing liquid to said basket; reversible rotary drive means mounted to said tub; transmission means mounted to said tub and having:

(a) a first eccentric drive assembly operatively connected to said reversible rotary drive means, (b) a second eccentric drive assembly operatively connected to and driven by said first eccentric drive assembly with its axis of rotation spaced a first predetermined distance from the axis of rotation of said first eccentric drive assembly, (c) rotary output means operatively connected to and driven by said second eccentric drive asembly with its axis of rotation spaced a second predetermined distance from the axis of rotation of said second eccentric drive assembly, (d) lost-motion means for limiting relative movement of said first and second eccentric drive assemblies between first and second relative angular positions, the axis of said rotary output means being spaced from the axis of rotation of said first eccentric drive assembly a distance equal to the total of said first and said second predetermined distances when said first and second eccentric drive assemblies are in their first relative angular positions, and rotation of said first eccentric drive assembly in a first direction by said rotary drive input means being effective to cause said first and second eccentric drive assemblies to assume their first relative angular positions, means interconnecting said rotary output means and said basket so that movement of said rotary output means by rotation of said first eccentric drive assembly in the first direction is operative to move said basket in an orbital path for imparting mechanical energy to the fabric articles causing the fabric articles to be washed by the washing liquid.

39. The washing machine of claim 38 wherein said transmission means is constructed and arranged such that, when said first and second eccentric drive assemblies are in their second relative angular positions, the axis of rotation of said rotary output means is aligned with the axis of rotation of said first eccentric drive assembly means to centrifugally extract washing liquid from the fabric articles; and rotation of said first eccentric drive assembly in a second direction by said rotary drive input means is operative through said lost-motion means to move said first and second eccentric drive assemblies to their second relative angular positions.

40. The washing machine of claim 39 further including clutch means interconnecting said second eccentric drive assembly and said rotary output means for rotation of said rotary output means about its own axis when said first and second eccentric drive assemblies are in their second relative angular positions.

41. The washing machine of claim 38 further including eccentric coupling means for interconnecting said basket to said tub, said coupling means being operative to restrain said basket from rotating about its own axis during orbital motion of said basket.

42. The washing machine of claim 38 wherein said first and said second predetermined distances are equal.

43. The washing machine of claim 38 wherein the orbital movement of said basket when said first and second eccentric drive assemblies are in their first relative angular positions has substantially the same angular speed as the rotation of said basket when said first and second eccentric drive assemblies are in their second relative angular positions.

44. In a clothes washing machine: a top-loading clothes basket having a central axis; transmission means for translating said basket to wash the clothes and for rotating said basket to centrifugally extract liquid from the clothes, said transmission means having a drive shaft rotatable about its own axis and an output shaft, each of said shafts extending in the same direction as said central axis and said output shaft being connected to said clothes basket; said transmission means having interconnecting elements therein for driving said output shaft from said drive shaft, said drive elements including selective shifting means for shifting the axis of said output shaft laterally from the axis of the drive shaft thereby to translate said output shaft in an orbital path relative to the axis of said drive shaft, and for shifting the relative position of the axes of said input and drive shafts into alignment thereby to rotate said output shaft; said basket being driven by the orbital movement of said output shaft to produce a clothes washing action and by the rotation of said output shaft to produce a centrifugal extraction.

45. In a clothes washing machine: a top-loading clothes basket having a central axis; transmission means for translating said basket to wash clothes and for rotating said basket to centrifugally extract liquid from the clothes; said transmission means having a drive shaft rotatable about its own axis and an output shaft, each of said shafts extending in the same direction as said central axis and said output shaft being connected to said clothes basket; said transmission means having interconnection elements therein for driving said output shaft from said drive shaft, said interconnection elements including off-setting means for shifting the axis of said output shaft laterally from the axis of the drive shaft when said drive shaft is driven in one direction thereby to translate said output shaft in an orbital path relative to the axis of said drive shaft, and for aligning the axes of said drive and output shafts when said drive shaft is driven in the other direction, thereby to rotate said output shaft; said basket being driven by the orbital movement of said output shaft to produce a clothes washing action and by the rotation of said output shaft to produce a centrifugal extraction action.

46. The combination of claim 44 or claim 45 wherein translation of said output shaft in an orbital path relative to the axis of said drive shaft is effective to translate said basket in a circulate path having an excursion substantially less than the width of said basket.

47. The combination of claim 46 including means for introducing washing liquid onto the clothes during translation of said basket.

48. The combination of claim 47 wherein said basket is provided with openings in the bottom thereof for draining washing liquid therefrom continuously during the washing action.

49. The combination of claim 48 including means for forming a shallow pool of washing liquid at the bottom of said basket during the washing operation, said means providing for continuous draining from said pool as washing liquid flows into said pool.

50. The combination of claim 44 or 45 further including a plurality of generally vertically extending ribs formed on the inner surface of the outside wall of the clothes basket for increasing the movement of the clothes caused by contacts with said outside wall.

51. The combination of claim 44 or 45 wherein said basket includes a central part having a flared skirt at the bottom thereof, said skirt having vanes formed thereon, said vanes extending radially outward and sloping downwardly in the direction of clothes movement.

52. The combination of claim 44 or 45 further including a plurality of inclined vanes formed on the inner surface of the outside wall of said basket, said vanes extending upwardly from the lower portion of said basket and being inclined in the direction of movement of the clothes during washing, for causing the clothes to turn over during washing.

53. A fabric washing machine comprising: a washing machine cabinet structure; a tub structure supported in said cabinet structure by suspension means allowing said tub structure freedom of movement within said cabinet structure; a perforate receptacle positioned in said tub to receive washing liquid and fabric articles to be washed by the liquid and including an upstanding sidewall; means for supplying washing liquid to said receptacle and means for draining liquid from said receptacle, said liquid supply means and said drain means together constituting means effective to maintain the fabric article load in a liquid-soaked condition while accumulating no more liquid in said receptacle than would immerse the lower portion of a full load of fabric articles; transmission means supported by said tub and operatively connected to said receptacle for moving said receptacle relative to said transmission so that the axis of said receptacle moves in a path about a second axis defined by said transmission and selectively displaced from the axis of said receptacle while restraining said receptacle from rotating about its own axis to cause repeated contacts between said sidewall of said receptacle and the fabric articles; a drive motor supported by said tub structure and drivingly connected to said transmission; said tub structure, transmission and drive motor having a combined mass substantially larger than the mass of said receptacle; whereby the dominant portion of the input energy from said drive motor is imparted to the receptacle for washing the fabric articles by the repeated contacts while concurrently substantially isolating said cabinet structure from the vibrations associated with said movement of said receptacle.

54. The washing machine of claim 53 wherein said transmission includes means for moving said receptacle to bring its axis into substantial alignment with the second axis and for rotating said receptacle to centrifugally extract washing liquid from the fabrics.

55. A washing machine as set forth in claim 53 further including friction damping means engaging said tub structure for damping oscillation of said tub structure.

56. The washing machine of claim 53 wherein said receptacle includes a bottom portion having an upright conical section positioned opposite said sidewall for urging fabrics toward said sidewall.

57. The machine of claim 53 further including means formed on said sidewall of said receptacle for repeatedly contacting the fabrics during movement of said receptacle about the second axis displaced from the axis of said receptacle to induce annular movement of the fabric article load.

58. The washing machine of claim 57 wherein said means formed on said sidewall comprises a plurality of substantially vertically extending ribs projecting into said receptacle.

59. The washing machine of claim 58 wherein at least one spiral vane is formed on said sidewall, projecting into said receptacle and inclined in a direction for inducing turnover of the fabric article load.

60. The washing machine of claim 59 wherein said at least one spiral vane projects into said receptacle from said sidewall a distance sufficient to create turbulence for separating fabrics.

61. The washing machine of claim 57 wherein said receptacle includes a bottom portion having an upright conical section positioned opposite said sidewall for urging fabric articles toward said sidewall, said conical section including at least one spiral vane formed thereon, projecting into said receptacle and inclined in a direction for inducing turnover of the fabrics.

62. A washing machine for fabric articles comprising: a fabric receiving receptacle having a central axis; means for introducing washing liquid onto the articles; means for selectively shifting the receptacle axis to selectively laterally offset the axis with respect to a predetermined axis; means for moving the offset receptacle axis about the predetermined axis; and means for restraining the receptacle from rotating about its axis during movement of the receptacle axis about the predetermined axis.

63. The washing machine of claim 62 wherein the predetermined axis is parallel to said receptacle axis.

64. The washing machine of claim 62 further including means for rotating said receptacle for centrifugal extraction of liquid from the fabric articles.

65. The washing machine of claim 64 further including means to shift the receptacle axis into substantially coaxial alignment with said predetermined axis for rotation of the receptacle.

66. In a washing machine: a receptacle having a central axis and arranged to receive washing liquid and fabric articles to be washed by the liquid; means for supplying washing liquid to said receptacle; drive means connected to said receptacle and operative to drive said receptacle so that the central axis moves in an orbital path, the excursion of the orbital path being substantially less than the width of said receptacle; said receptacle having an upright central portion, an annular bottom portion extending substantially radially outward from said central portion and having a plurality of apertures therethrough, said central portion including a generally conical section projecting upwardly from the radially inner circumference of said annular bottom portion, said conical section including a plurality of radially outwardly projecting vanes spiralling downwardly in a direction opposite to the direction of movement of said receptacle, and said receptacle also having an outer wall extending generally upwardly from the outer circumference of said bottom portion and having a plurality of apertures therethrough; the movement of said receptacle in the orbital path being effective to cause said receptacle outer wall repeatedly to contact the fabric articles for imparting washing energy to the fabric articles.

67. The washing machine of claim 66 wherein said central portion of said receptacle further includes an upright post rising substantially vertically from the upper end of said conical section.

68. The washing machine of claim 67 wherein said post includes an open-topped, additive-dispensing receptacle, said additive-dispensing receptacle receiving washing liquid from said supply means and operative to dispense a solution of liquid and additive onto said articles.

69. The washing machine of claim 66 wherein said annular bottom portion of said receptacle includes elevated means projecting vertically from said bottom portion and effective to space the fabric articles from the apertures in said bottom section to permit liquid to flow through the apertures.

70. The washing machine of claim 69 wherein said elevated means comprises a plurality of annular ribs.

71. The washing machine of claim 69 further including means for creating a limited pool of washing liquid encompassing the lower section of said receptacle for enhancing removal of particulate soil from said receptacle.

72. The washing machine of claim 71 wherein said means for creating a liquid pool comprises a shallow annular pan mounted below and extending circumferentially of the lower section of said receptacle.

* * * * *

UNITED STATES PATENT AND TRADEMARK OFFICE

CERTIFICATE OF CORRECTION

PATENT NO. : 4,328,600

DATED : May 11, 1982

INVENTOR(S) : John Bochan

It is certified that error appears in the above—identified patent and that said Letters Patent is hereby corrected as shown below:

Column 28, line 8, after "path" insert -- of the axis --.

Signed and Sealed this

*Thirty-first* Day of *August 1982*

[SEAL]

*Attest:*

GERALD J. MOSSINGHOFF

*Attesting Officer*

*Commissioner of Patents and Trademarks*